US007021389B2

(12) United States Patent
Bishop et al.

(10) Patent No.: US 7,021,389 B2
(45) Date of Patent: Apr. 4, 2006

(54) BI-DIRECTIONAL BALL SEAT SYSTEM AND METHOD

(75) Inventors: Floyd Romaine Bishop, Humble, TX (US); Marvin Bryce Traweek, Houston, TX (US); Richard J. Ross, Houston, TX (US); David J. Walker, Lafayette, LA (US); DeWayne M. Turner, Tomball, TX (US)

(73) Assignee: BJ Services Company, Houston, TX (US)

( * ) Notice: Subject to any disclaimer, the term of this patent is extended or adjusted under 35 U.S.C. 154(b) by 46 days.

(21) Appl. No.: 10/373,319

(22) Filed: Feb. 24, 2003

(65) Prior Publication Data

US 2004/0163820 A1 Aug. 26, 2004

(51) Int. Cl.
*E21B 34/14* (2006.01)

(52) U.S. Cl. ..... 166/373; 166/386; 166/317; 166/318; 166/332.1

(58) Field of Classification Search ..... 166/316–319, 166/321, 325, 328, 332.1, 334.1, 376, 373, 166/386
See application file for complete search history.

(56) References Cited

U.S. PATENT DOCUMENTS 2,319,514 A * 5/1943 Penfield ..... 138/45
2,717,646 A * 9/1955 Johnston ..... 166/318
4,018,284 A * 4/1977 Perkins ..... 166/278
4,114,694 A 9/1978 Dinning
4,263,936 A 4/1981 Brown
4,543,703 A 10/1985 Wetzel et al.
4,951,750 A 8/1990 Wetzel, Jr.
5,375,662 A * 12/1994 Echols et al. ..... 166/386
5,413,180 A 5/1995 Ross et al.
5,462,121 A 10/1995 Schmuck et al.
5,641,023 A 6/1997 Ross et al.
6,464,006 B1 10/2002 Womble
6,820,697 B1 * 11/2004 Churchill ..... 166/374

* cited by examiner

*Primary Examiner*—Kenneth Thompson
(74) *Attorney, Agent, or Firm*—Locke Liddell & Sapp LLP

(57) ABSTRACT

The present invention provides a bi-directional ball seat and method of use. In at least one embodiment, the present invention provides a fluid control system that includes a radial protrusion that can be selectively engaged and disengaged upstream and/or from a ball seat. For example, a ball can be placed in a passageway, engaged with a downstream ball seat, and the radial protrusion radially extended into the passageway distally from the seat relative to the ball. A reverse movement of the ball is restricted by the active radial movement of the radial protrusion into the passageway. The control system can be used to control a variety of tools associated with the well. Without limitation, the tools can include crossover tools, sleeves, packers, safety valves, separators, gravel packers, perforating guns, decoupling tools, valves, and other tools know to those with ordinary skills in the art.

43 Claims, 10 Drawing Sheets

BI-DIRECTIONAL BALL SEAT SYSTEM AND METHOD

FIELD OF THE INVENTION

This invention relates to hydrocarbon well devices and processes. More specifically, the invention relates to a control system for controlling fluid flow and actuating various tools associated with hydrocarbon wells.

BACKGROUND OF THE INVENTION

Typical hydrocarbon wells, whether on land or in water, are drilled into the earth's surface to form a well bore. A protective casing is run into the well bore and the annulus formed between the casing and the well bore is filled with a concrete-like mixture. Several types of tools are run into the casing for the various procedures used to complete and subsequently produce hydrocarbons from the well. Some of these procedures include perforating the casing and the concrete-like mixture. The perforating process creates channels into production zones of the earth at appropriate depths to allow the hydrocarbons to flow from the production zone through the casing and into production tubing for transport to the surface of the well. Another procedure includes gravel packing adjacent to the production zone to filter out in situ particles of sand and other solids from the production zone that are mixed with the hydrocarbons before the hydrocarbons enter the production tubing. Another procedure includes removing various tools to allow production of the well once it is completed.

Other tools and processes are needed to efficiently produce hydrocarbons including tools for filtration and separation of hydrocarbons from entrained water, tools that allow sealing of the well bore in case of explosion, rotating and drilling equipment in the well's initial phases, subsequent operations that can maintain the effectiveness and production of the well, and other related processes known to those with ordinary skills in the art, whether above or below the well surface. Most of the tools and related procedures require control of the various tools at appropriate stages of the operations.

Without limitation, one typical method of controlling the actuation of various tools at different stages includes the use of tools that have parts slidably engaged with each other. Often, although not necessarily, the parts are at first restrained from relative movement by the use of shear pins and other restraining devices. At an appropriate stage, the shear pins or other restraining devices are sheared or otherwise removed to allow a desired relative movement, such as actuation of the tool or for other purposes. Further, multiple sets of shear pins or other restraining devices can be used to implement multiple stages of actuation for the control system on the appropriate tool.

One typical method of actuation includes providing a ball seat on a tool. The ball seat is positioned in a passageway of tubing that can be used to create a flow blockage in the passageway. A ball or other obstruction can be placed in the passageway at an appropriate time to seat against the ball seat and effectively seal off the passageway. Fluid in the passageway that is blocked is then pressurized, creating an unequal force on the blocked portion of the tool. If present, a shear pin or other restraining device is sheared or otherwise removed and the tool portion moves into an appropriate position. Sometimes the movement can close or open ports, release or engage associated tools, change flow patterns and control fluids, and other functions known to those with ordinary skills in the art. For example, controlling fluids can include controlling a reversal of fluid flow caused by an unexpected downstream pressurization of production fluids.

However, one issue that has remained problematic is how to restrict the ball or other device from reversing up the passageway from the direction in which it entered the passageway once it has been placed on the ball seat. Further, some of the control logic of controlling the tool is lessened by the inability of the ball to seal in a reverse direction. For example, it could be advantageous to seal in one direction to effectuate one series of procedures and to seal in a reverse direction to control other procedures. Because the ball is typically inserted into a tubing passageway and generally flows downstream in the passageway to a remote site that has the ball seat, it has heretofore been difficult to construct a remote restraining device in the reverse direction.

In some prior efforts, some reverse direction restrictions have been attempted by providing a closely dimensioned upstream shoulder that the ball can be forced past, before engaging the downstream ball seat. At least two disadvantages occur with this method. First, the ball is not actively captured. A sufficient pressure reversal can force the ball back upstream and past the shoulder. The shoulder's ability to restrict a reverse travel is limited and does not correspond with the general strength of the tool to withstand various operating pressures.

Another procedure that has been used is to restrict reverse movement of the ball is to form a conical ball seat in the passageway. A ball placed in the passageway engages the conical ball seat and becomes wedged therein. However, similar problems occur in this type of seat. The ability to withstand a reverse pressurization in the passageway can be lower than tool's capabilities, because the ball can simply become dislodged back up the passageway.

Neither of the above arrangements actively control the ball in the reverse direction. The reversal control ability is simply dependent upon the original size and configuration, and thus the reverse control capabilities of the tools are limited.

Therefore, there remains a need to actively control and produce a fully capable control system associated with hydrocarbon wells.

SUMMARY OF THE INVENTION

The present invention provides a control system and method of use. In at least one embodiment, the present invention provides a fluid control system that includes a radial protrusion that can be selectively engaged and disengaged upstream and/or from a ball seat. For example, a ball can be placed in a passageway, engaged with a downstream ball seat, and the radial protrusion radially extended into the passageway distally from the seat relative to the ball. A reverse movement of the ball is restricted by the active radial movement of the radial protrusion into the passageway. The control system can be used to control a variety of tools associated with the well. Without limitation, the tools can include crossover tools, sleeves, packers, safety valves, separators, gravel packers, perforating guns, decoupling tools, valves, and other tools know to those with ordinary skills in the art.

In some cases, the control system provides a blocked passageway can be further pressurized to force further movement, so that the ball and ball seat enter an additional region of control. For example, the ball can move to a second, third, or other subsequent tool or portion of the tool for subsequent procedures. In other cases, the ball moves to a release position for discarding, such as to remote areas of the well. In other cases, the ball is inserted in the passageway and then restricted in a reverse direction to which it entered the passageway.

In at least one embodiment, the present invention provides a fluid control system for a hydrocarbon well, comprising a first portion of the control system; an actuator coupled to the first portion; an inner sleeve slidably disposed inside the first portion and forming a longitudinal passageway; a seat coupled to the control system and exposed to the passageway; a passageway seal coupled to the inner sleeve and exposed to the passageway; and a radial protrusion disposed at least partially in the inner sleeve and distal from the seat relative to the passageway seal, the radial protrusion adapted to have a radial position retracted from the passageway and another radial position extended into the passageway, the radial positions determined by engagement of the protrusion with the actuator, the seat and the radial protrusion being adapted to selectively restrict in at least one direction movement of the movable restriction through the passageway, and the control system adapted to selectively restrict flow in at least one direction by sealing engagement with the movable restriction inserted in the passageway.

The invention also provides a fluid control system for a hydrocarbon well, comprising a first portion of the control system having an actuator; an inner sleeve slidably disposed inside the first portion and forming a longitudinal passageway; a seat coupled to the control system and exposed to the passageway; and a radial protrusion disposed at least partially in the inner sleeve, the radial protrusion adapted to have a position retracted from the passageway and another position extended into the passageway, the positions determined by engagement of the protrusion with the actuator, the seat and the radial protrusion being adapted to selectively restrict in at least one direction movement in the passageway of a movable restriction disposed in the passageway between the seat and the radial protrusion.

The invention also provides a method of using a fluid control system for a hydrocarbon well, the control system comprising a first portion having an actuator, an inner sleeve slidably disposed with the first portion and forming a longitudinal passageway, a seat coupled to the control system and exposed to the passageway, and a radial protrusion disposed at least partially in the inner sleeve and exposed to the passageway with the seat, the method comprising using the control system in a location associated with the well with the radial protrusion retracted from the passageway; allowing a movable restriction to engage the seat; and moving the inner sleeve relative to the first portion to cause the actuator of the first portion to extend the radial protrusion into the passageway to selectively restrict the longitudinal travel of the movable restriction between the radial protrusion and the seat.

The invention also provides a method of using a fluid control system for a hydrocarbon well, the control system comprising a first portion having at least one actuator, an inner sleeve slidably disposed with the first portion and forming a longitudinal passageway, and at least two radial protrusions disposed at least partially in the inner sleeve and exposed to the passageway, at least two of the radial protrusions being adapted to selectively extend into and retract from the passageway, the method comprising using the control system in a location associated with the well with the two radial protrusions extended into the passageway and with a movable restriction disposed in the passageway and restricted in longitudinal travel between at least two of the extended radial protrusions; moving the inner sleeve relative to the first portion so that at least one of the radial protrusions retracts from the passageway to selectively release the movable restriction from between the radial protrusions.

Further, the invention provides a fluid control system for a hydrocarbon well, comprising a first portion of the control system having an actuator; an inner sleeve slidably disposed inside the first portion and forming a longitudinal passageway; a seat coupled to the control system and exposed to the passageway; a movable restriction adapted to restrict flow in the passageway when engaged with the seat, wherein the movable restriction comprises a covering disposed over a disintegratable core.

DETAILED DESCRIPTION OF THE INVENTION

Figure 1B:
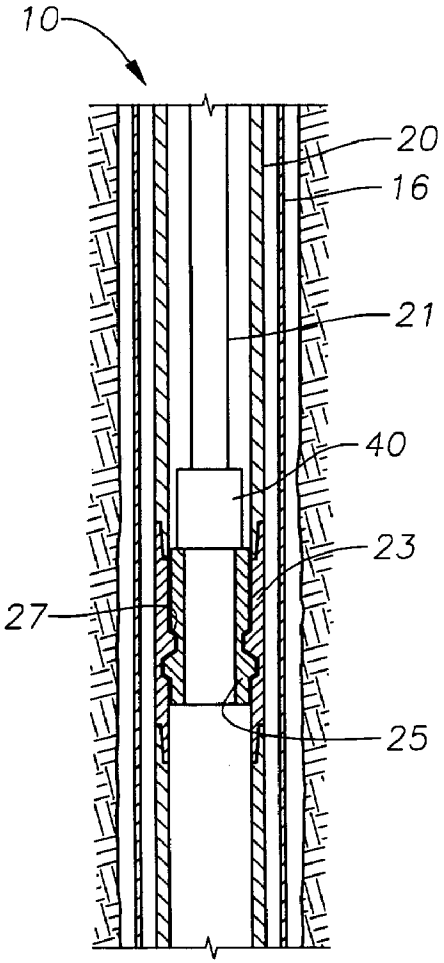
FIG. 1B is a schematic cross-sectional view of a well with another embodiment of the control system.
Figure 1A:
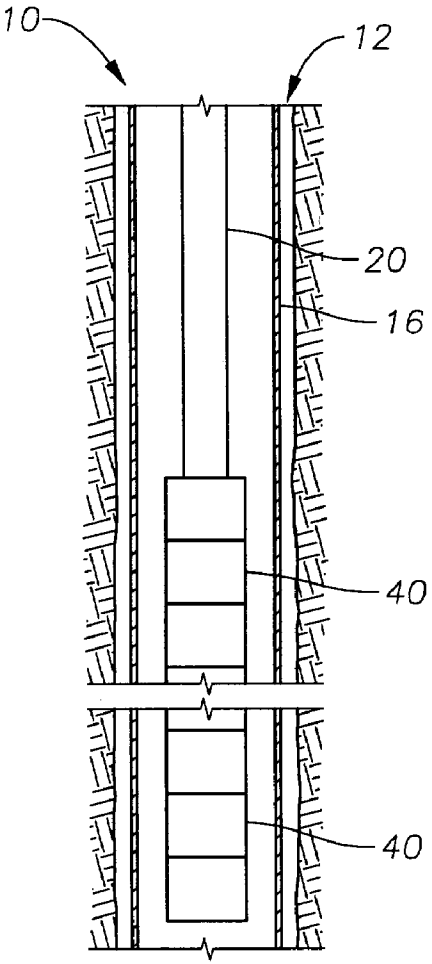
FIG. 1A is a schematic cross-sectional view of a well with a control system of the present invention.
Figure 1:
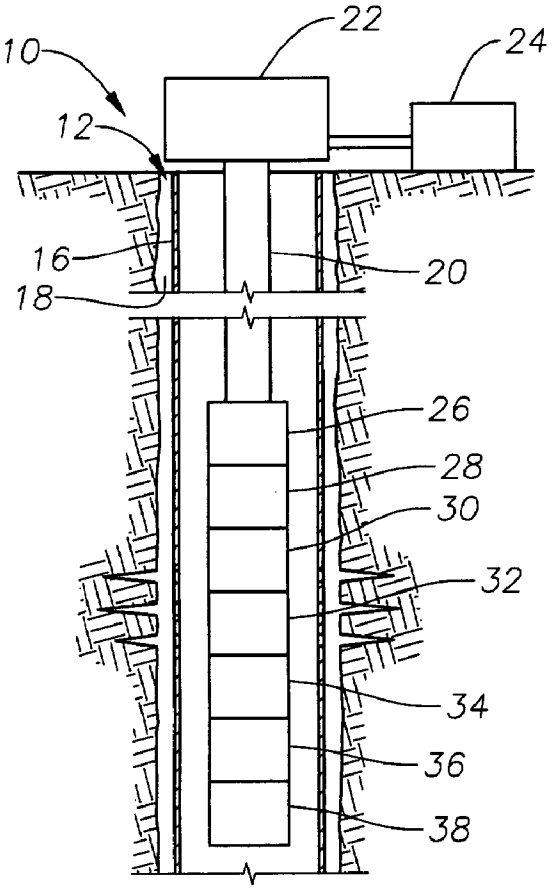
FIG. 1 is a schematic cross-sectional view of a well with various tools disposed therein.

FIG. 1 is a schematic cross-sectional view of a well with various tools disposed therein. A well 10 is generally used to recover below-surface minerals such as gas, oil, and other minerals, hereinafter termed "hydrocarbons." Generally, a well bore 12 is formed in the surface of the ground or subsea layers 14. A casing 16 is normally inserted in the well bore 12, when the well bore has been drilled to a certain desired depth. An annulus 18 between the casing and the well bore 12 is generally filled with a cement-like substance. A tubular string 20 is inserted in the casing 16. The tubular string can be a completion string, coiled tubing, a production string, wireline, and other members that are inserted down the casing 16 for different processes used to ultimately extract the hydrocarbons from the underlying layers through which the well bore is formed. Various equipment can be attached directly or indirectly to the tubing string below or above the surface. For example, a blow-out preventer or other equipment 22 can be attached to the upper portion of the tubing string 20. Additionally, auxiliary equipment 24, such as fluid and solids separators, power supplies, pumps, rotary drilling heads, sensors, support equipment, and other associated equipment is generally used in the drilling, completion, and subsequent production of the well. Some of the tools that can be attached to the down hole portion of the tubular string that are inserted below the surface 14 can include, for example and without limitation, a setting tool 26, a gravel packer 28, a crossover tool or closing sleeve 30, a screen 32, a packer 34, a decoupling tool 36, a perforating gun 38, and other tools, as would be known to those with ordinary skill in the art. Without limitation, one tool that can advantageously use the control system described herein is described in patent application U.S. Ser. No. 60/214,689, filed Aug. 24, 2001, and is incorporated herein by reference. One or more of these various tools can be inserted individually down the well or in one or more assemblies with each other, depending upon the particular requirements and desires of the drilling and production engineers.

The tools can be used in a location associated with the well, such as adjacent to the well, in the flow path of the well fluids, on the surface of the well, or down hole in the well bore. Many of the tools require various control systems to either actuate the tool or de-actuate the tool or affect other tools coupled thereto, including for example, the setting tool 26, the packers 28, 34, the crossover tool or closing sleeve 30, the decoupling tool 36, the perforating gun 38, and others. Often the control system must work remotely, such as down hole, or in other assemblies having difficult access.

The present invention provides a control system adaptable to be coupled to or formed with many of the tools generally associated with a hydrocarbon well and can be a "tool" as the term is broadly used by providing a control element to a well. However, it is to be understood that the control system can be used for other purposes besides producing hydrocarbons. The invention described herein is limited only by the claims that follow. Further, in general, the present invention uses the concept of blocking passageways and pressurizing fluids disposed therein to cause relative movement between portions of the control system. The relative movement causes various alignments and radial movements within the control system. However, it is to be understood that other modes of movement besides pressurization are included within the scope of the claims recited herein and can include, without limitation, electrical, mechanical, pneumatic, hydraulic, chemical, and other forms of actuation. Thus, the embodiments disclosed herein are only exemplary of the concepts embodied herein and recited in the accompanying claims.

FIG. 1A is a schematic cross-sectional view of a well with a control system. Similar elements from FIG. 1 are similarly numbered throughout the various figures herein. The well 10 generally includes a casing 16 inserted into the well bore 12. The tubular string 12 generally includes one or more tools coupled thereto. A control system 40 can be coupled to the tubing string directly or indirectly through intervening tools. Further, additional control systems 40 can be coupled thereto for additional concurrent or subsequent control efforts. Thus, one or more control system can be arranged in modular units as appropriate to the functions desired in the well 10.

FIG. 1B is a schematic cross-sectional view of a well with another embodiment of a control system. The tubular string 20 is disposed in the well 10, generally inside a casing 16. The tubular string can be temporarily or permanent and can be an existing installation. In at least one embodiment, a tool 23, such as a seating nipple or other locating tool, is coupled to the tubular string 21. Another tubular string 20 can be inserted through the tubular string 21. The tubular string 21 generally includes a mating portion 25 of the tool 23, if present, and a control system 40 coupled thereto as a cartridge unit. The control system 40 is located by engaging the tool 23 with the mating portion 25. The control system can therefore restrict flow in the tubular string 21 for control of tools, such as those shown in FIG. 1. The control system can be retrieved or left in place, depending on the particular operation of the well.

FIGS. 2A–2D illustrate one embodiment of the control system 40 and a non-limiting sequence of the progression and interaction between a radial protrusion, a movable restriction, and a seat. It is to be understood that other sequences both prior to and after the illustrated sequences are possible and are contemplated in the present invention. For example, the radial protrusion can be initially retracted and subsequently extended or vice versa.

Figure 2A:
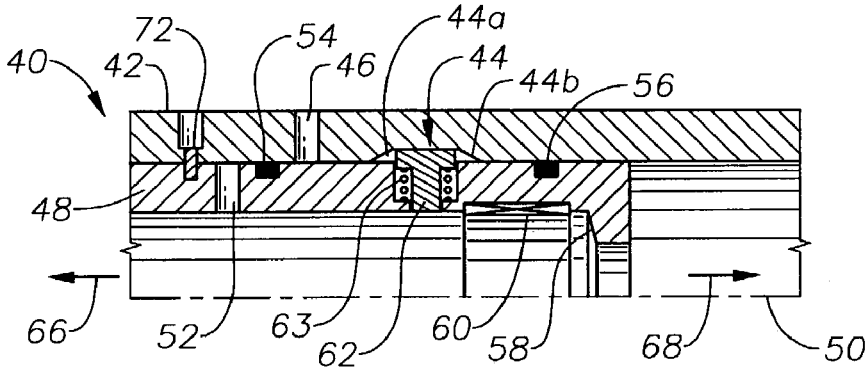
FIG. 2A is a schematic cross-sectional view of one embodiment of the control system.
Figure 2B:
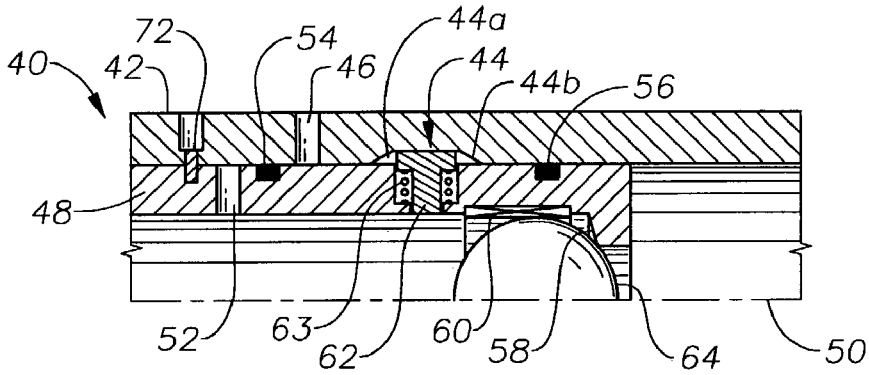
FIG. 2B is a schematic cross-sectional view of the embodiment of FIG. 2A wherein the ball or other movable restriction has engaged a ball seat.
Figure 2C:
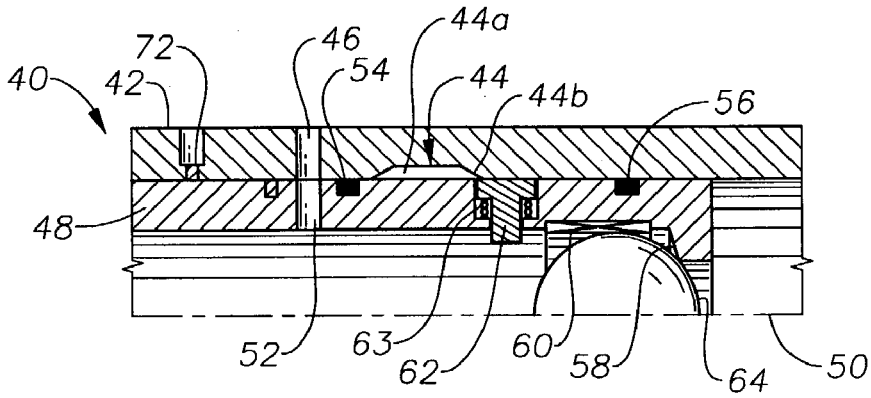
FIG. 2C is a schematic cross-sectional view of embodiment of FIG. 2B wherein the parts are shifted and a radial protrusion is extended into a passageway to block the reverse travel of the ball or other movable restriction.
Figure 2D:
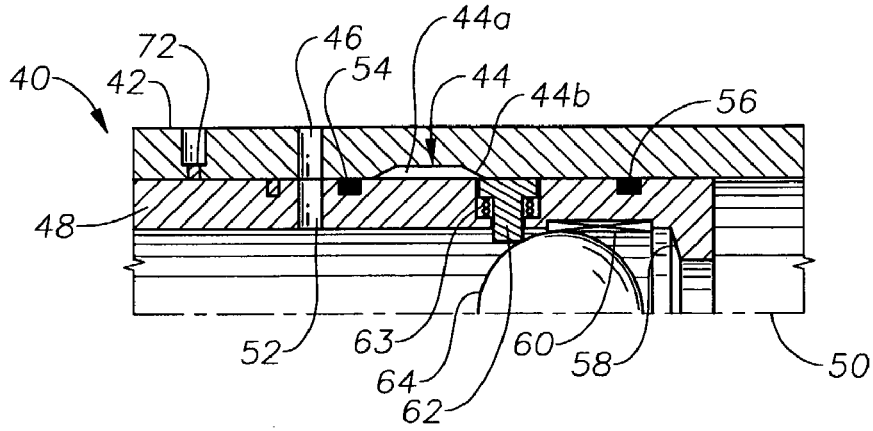
FIG. 2D is a schematic cross-sectional view of the embodiment shown in FIG. 2C wherein a reversal of fluid flow downstream of the ball or other movable restriction has occurred and shifted the movable restriction against the radial protrusion.

FIG. 2A shows a first portion 42 and an inner sleeve 48 in a position with the radial protrusion retracted at least partially out of the passageway. FIG. 2B shows a movable restriction 64 inserted into a passageway 50 and engaged with a seat 58. FIG. 2C shows the relative movement between the first portion 42 and the inner sleeve 48, so that the radial protrusion 62 has been actuated and extended at least partially into the passageway 50. FIG. 2D shows the movable restriction unseated from the seat 58 and engaged against the protrusion 62. FIGS. 2C and 2D illustrate that the passageway seal 60 can seal against the movable restriction in an upstream or downstream position between the seat 58 and radial protrusion 62.

Having briefly described the intent of FIGS. 2A–2D, further details are described below. Similar elements are similarly numbered throughout the various figures.

FIG. 2A is a schematic cross-sectional view of one embodiment of the control system of the present invention in a position. The control system 40 includes a first portion 42 and an inner sleeve 48 associated with the first portion 42. The first portion 42 can be an outer sleeve disposed on a periphery of the tool or disposed within the tool. Further, the first portion 42 can be other members besides a sleeve as may be appropriate in a given situation. It is advantageous that the first portion 42 allows movement of the inner sleeve 48 relative thereto. In at least one embodiment, the first portion 42 generally includes an actuator 44. The actuator 44 generally includes the combination of the recess 44*a* and step 44*b* in a radial direction. Sliding movement of the sleeve 48 along the recess 44*a* and step 44*b* assists in actuating the control system, as described herein. Other actuators can include other modes of movement as noted above.

In some embodiments, a port 46 can be formed through the first portion 42 for communication between an inner and outer volume. For example, an inner volume can be a passageway 50 formed within the tubular string 20, in reference to FIG. 1, and an outer volume (not labeled) can be a portion outside the tool in an annulus formed between the string 20 and the casing 16, also referring to FIG. 1. While the actuator 44 is shown as a recess 44*a* and step 44*b* (biased radially outward), it is to be understood that the differences in radial dimensions could be switched, so that recess 44*a* is aligned with an inner surface of the first portion 42 and the step 44*b* could extend beyond the inner surface of the first portion 42 (biased radially outward) in this and any other embodiment. Further, the actuator 44 can be configured to other portions of the control system 40. In general, it is the interaction between the various control system portions that cause the movable restriction to be secured between downstream and upstream surfaces.

As mentioned, an inner sleeve 48 is generally disposed within the first portion 42. While the term "sleeve" is used to generally reflect a hollow tubular member, it is to be understood that the term is used broadly to encompass any movable part having an internal volume through which a fluid can pass, regardless of the geometry.

A port 52 can be disposed through the inner sleeve 48 to connect an inner and outer volume (not labeled), similar to port 46 of the first portion 42. The port 52 can be offset from port 46 in at least one embodiment so that flow therebetween is restricted. Relative movement of the control system 40 can cause alignment of the ports to allow subsequent flow therethrough. In other embodiments, the control system can align ports 46 and 52 and subsequently misalign the ports to subsequently restrict the flow. In some embodiments, it can be advantageous to include one or more seals 54, 56 at one or more positions to restrict flow between the first portion 42 and sleeve 48.

Further, a shear pin 72 can be used to secure the movement between the first portion of 42 and the inner sleeve 48. The term "pin" is defined broadly to include any device that can be used to restrain the relative movement between two portions of the control system, including, without limitation, pins, dogs, threads, springs, C-ring, solenoids, and other restraining devices. Further, the pin 72 can be disposed at different positions relative to the first portion 42 and inner sleeve 48.

A lock (not shown) such as a spring-loaded pin or other element, can be used to lock the inner sleeve 48 after movement to restrict reverse movement, as would be known to those with ordinary skill in the art.

In at least one embodiment, the inner sleeve 48 includes a seat 58. The seat is generally exposed to the passageway at some time in the control system actuation, so that a movable restriction inserted in the passageway can engage the seat. The seat 58 can be fixed or movable as described below. When movable, the seat can function as a radial protrusion and the description of the radial protrusion below can be applied to the seat. The seat 58 is generally used to at least temporarily stop movement of a movable restriction, such as a ball, inserted into the passageway 50. The seat can be continuous or segmented at the choice of a designer. In some instances, the seat can include a seal or at least a sealing surface. Thus, the seat is coupled with the control system 40 and used in conjunction therewith to receive the movable restriction in the passageway. In some embodiments, the seat is coupled to the inner sleeve 48 and, in other embodiments, the sleeve is coupled to the first portion 42.

A passageway seal 60 can be coupled to the inner sleeve and exposed to the passageway 50. The terms "coupled," "coupling," or similar terms are used broadly herein and include, without limitation, any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include integrally forming one functional member with another. The coupling can occur in any direction, including rotationally.

The passageway seal 60 is generally made of a compressible material such as an elastomeric material. However, any material to which the movable restriction, described below, can seal against is suitable for the purposes of the present invention. In some embodiments, the passageway seal 60 is not necessary to effect the purposes of the control system and can be eliminated. For example, the passageway seal can be extraneous to effect sealing with the seat, if the seat includes a sealing surface, although the passageway seal can be used in conjunction with a radial protrusion, described below.

A radial protrusion 62 is advantageously used in the present invention. The radial protrusion can be biased in a radially outward direction by a bias element 63 against the face of the recess 44*a*. The bias element 63 can include for example a spring, compressible washer, and other bias elements known to those with ordinary skill in the art. As described, the actuator can be biased radially inward or outward. For convenience, the radial protrusion 62 is shown as biased outwardly so that an actuator can possible engage the protrusion in a radially inward direction. Depending upon the desires of the designer, the bias and/or the actuation could be in a reverse direction. Further, the actuation could be upstream 66 or downstream 68, that is, longitudinally along the passageway 50 as well, although elements 66 and 68 could represent downstream and upstream, respectively as well.

The radial protrusion can be a pin, "dog", C-ring, or other elements that can be used to retract and extend directly or indirectly into the passageway 50. The radial protrusion is shown as a "T" shaped cross-sectional member to conveniently allow a landing (not labeled) for the bias element 63. However, it is to be understood that the shape can occur in many variations and is not so limited. Also, the radial protrusion can be made of material and shape to have integral bias capability, such as a flanged unit that flexes at the flange around the periphery. Other shapes are possible.

Further, in at least one embodiment, a series of radial protrusions can be disposed circumferentially around the passageway 50 in the inner sleeve 48. The circumferential collection of radial protrusions can function as a segmented ring. Alternatively, radial protrusion 62 can be a relatively continuous ring that can expand and contract circumferentially. A relatively continuous ring can be useful for sealing or other purposes.

In at least one embodiment, the passageway seal 60 is of sufficient longitudinal length so that the movable restriction can seal at a plurality of positions along the passageway 50. For example, a movable restriction can seal against the passageway seal 60 when the movable restriction is seated on the seat 58. The movable restriction can also seal against the passageway seal 60 when the movable restriction engages the radial protrusion 62 and the radial protrusion extends into the passageway. In other embodiments, the passageway seal 60 can be used to seal only with the radial protrusion.

FIG. 2B is a schematic cross-sectional view of the embodiment of FIG. 2A wherein the ball or other movable restriction has engaged a ball seat. A movable restriction can be dropped from an open well bore adjacent to the surface, can be temporarily suspended in the passageway above the control system 40 and subsequently released therein to travel downstream and engage the control system 40, can be included initially in a restricted position in the control system, or other methods of including the movable restriction within the passageway 50. For illustrative purposes, the movable restriction is shown as a ball. However, it is to be understood that the movable restriction can be any shape, including round, elongated, elliptical, and others. It can also have extensions, such as tails, and can be darts. In general, the movable restriction can be any object that can be used to at least partially block the fluid flow in the passageway at a particular time to an appropriate position in the passageway. For convenience, the movable restriction sometimes will be referred to herein as a "ball" and will incorporate at least the previous variations described.

In this particular embodiment and figure, the ball 64 is shown as being moved to a point at which further travel is restricted by the seat 58. In some embodiments, the passageway seal 60 can be positioned so that when the ball is seated against the seat 58, the ball also contacts the passageway seal 60 in sealing engagement therewith.

FIG. 2C is a schematic cross-sectional view of embodiment of FIG. 2B wherein the parts are shifted and a radial protrusion is extended into a passageway to block the reverse travel of the ball or other movable restriction. Fluid, such as from an upstream location, can be pressurized to a sufficient pressure after the ball 64 has engaged the seat 58, so that the inner sleeve 48 can be moved in the direction of the force created by the pressure, such as in a downstream direction. If the shear pin 72 is engaged between the inner sleeve 48 and the first portion 42, then a pressure sufficient to shear the pin can allow such movement.

Once the pin 72 has been sheared or otherwise dislocated, the inner sleeve 48 moves relative to the first portion 42. The protrusion 62 is actuated as a result of such movement. For example, in the embodiment shown in FIG. 2C, the protrusion 62 extends inward into the passageway and is otherwise exposed to the passageway when the radial protrusion moves from an engagement with the recess 44*a* to engagement with the step 44*b*. The configuration of the actuator 44 can positively lock the radial protrusion in position, such as an extended position, if desired. The extension of the radial protrusion provides a positive surface that can withstand significant pressure differentials on a restriction in the passageway, in contrast to former systems.

The term "retracted" and "extended" and like terms are used broadly herein and is intended to include at least partially retracted or partially extended. Further, the term "engaged" is used broadly herein and can either be a direct engagement with adjacent elements or indirect engagement through intermediate elements. If desired, the movement can also cause an alignment of the ports 46 and 52. Alternatively, the movement can cause a misalignment of the ports to otherwise restrict flow. The outward movement of the protrusion 62 locks or otherwise restricts the ball 64 bi-directionally in the passageway.

The ball 64 can in some embodiments move longitudinally along the passageway 50 between the seat 58 and the protrusion 62. In other embodiments, the ball 64 can be fixed in position between the seat and the radial protrusion. The ball 64 can engage the passageway seal 60 when the ball is engaged with the seat 58, or when the ball is engaged with the protrusion 62, or a combination thereof. The travel distance between the seat 58 and protrusion 62, which can be zero, generally depends upon the size and shape of the ball 64, the spacing between the seat 58 and protrusion 62, the extension of the protrusion 62 into the passageway 50, the shape of the seat or protrusion or both, and other factors as would be known to those with ordinary skill in the art. There can be no movement, little movement, or substantial movement of the ball 64 along the passageway 50, depending upon the above and other factors.

Further, the passageway seal 60 can be disposed to seal in only one position, such as at the seat 58 or the protrusion 62. For example, a person with ordinary skill in the art can elect to have a sealing engagement with the passageway seal 60 when the ball 64 is in contact with the seat 58, but not a sealing engagement when the ball is in contact with the protrusion 62 or vice versa. Other embodiments would be readily known or developed given the description contained herein of the invention.

FIG. 2D is a schematic cross-sectional view of the embodiment shown in FIG. 2C wherein a reversal of fluid flow downstream of the ball or other movable restriction has occurred and shifted the movable restriction against the radial protrusion. Such reversal can occur, for example, if the downstream pressure is greater than the upstream pressure, or otherwise the pressure in the passageway adjacent the seat 58 is greater than the pressure in the passageway adjacent the protrusion 62.

The engagement of the ball 64 against the protrusion 62 can be either sealing or non-sealing. For example, the protrusion 62 can include one or more pins exposed to the passageway and extending therein. To seal, the ball 64 can concurrently contact the passageway seal 60 to form a sealing engagement in the passageway 50, when the ball 64 is in contact with the protrusion 62. Alternatively, the ball can contact the protrusion 62 and the protrusion 62 itself forms a sealing engagement. In such example, the protrusion 62 would generally require a substantially complete contact with the ball 64 such as with the use of an expandable sealing ring or with use of other sealing, engagement methods known to those with ordinary skill in the art.

Figure 3A:
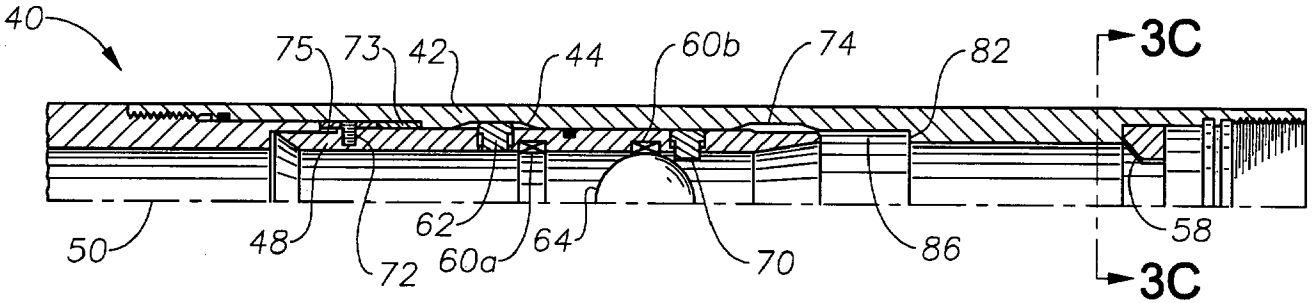
FIG. 3A is a schematic sectional view an exemplary embodiment of the present invention with at least one radial protrusion in a position.
Figure 3B:
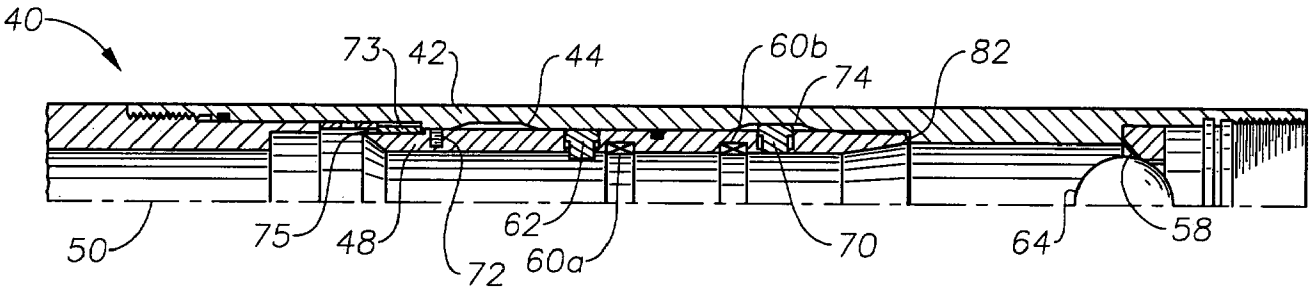
FIG. 3B is a schematic cross-sectional view of the embodiment shown in FIG. 3A with at least one other radial protrusion in another position.

FIGS. 3A–3B illustrate an additional embodiment of the present invention having a second radial protrusion that functions as a seat 58 described in FIGS. 2A–2D. Similar elements are similarly labeled. The description of various movements of this embodiment are similar to the above description regarding FIGS. 2A–D. One feature of this embodiment is that the control system 40 can be inserted in either direction upstream or downstream (with minor modification) so that, at least in one embodiment, the lower of the two radial protrusions is in an extended position and the upper radial protrusion is in a retracted position. In other embodiments, both radial protrusions can be extended into the passageway as an initial position with the ball 64 restricted therebetween. One example is described in reference to FIGS. 7A–7B, below.

Further, an aspect of this and other embodiments is that the first portion 42 can include an additional actuator 74 at the designer's option. The additional actuator can provide additional places of actuation as the inner sleeve 48 moves relative to the first portion 42.

FIG. 3A is a schematic cross-sectional view of an exemplary embodiment of the present invention with at least one radial protrusion in a position. The first portion 42 can include one or more actuators 44, 74. An inner sleeve 48 can include one or more radial protrusions and in the embodiment shown a plurality of radial protrusions 62, 70. The actuators are appropriately spaced and dimensioned to allow the plurality of radial protrusions 62, 70 to interact in the control system 40 as the inner sleeve 48 moves relative to the first portion 42. An initial relative movement between the first portion 42 and inner sleeve 48 can be fixed by a pin 72 coupled therebetween.

An optional lock 73 can operatively interact with the first portion 42 and inner sleeve 48. The lock 73 can restrict the amount of reverse movement, once the inner sleeve has moved relative to the first portion 42. The lock 73 can be a split ring, spring, or other biased element, a pin, dog, solenoid, latch, or other restraining device. In at least one embodiment, the lock 73 can be initially placed in the first portion 42 and biased against the inner sleeve 48. Movement of the inner sleeve relative to the first portion 42 can expose the lock 73 to a recess 75 formed in the inner sleeve. The biased lock engages the recess and restricts reverse movement of the inner sleeve relative to the first portion. Other embodiments are contemplated. For example and without limitation, the lock 73 could be disposed in the inner sleeve and engage a recess formed in the first portion. The above embodiments are only exemplary and others are possible, as would be known to those with ordinary skill in the art, given the teachings herein.

A stop 82 can be formed or otherwise coupled to the first portion 42 or other elements of the control system. A space 86 is formed between the opposing faces of stop 82 and inner sleeve 48 to allow room for the inner sleeve 48 to move relative to the first portion 42, and prior to contact with the stop 82. A seat 58 is coupled to the first portion 42 and located, for example and without limitation, downstream of the inner sleeve 48 and accompanying radial protrusions. If the control system 40 is to be placed in the passageway 50 in a reverse direction, the seat 58 and, in some cases, the actuators can be redesigned to an appropriate position.

In some embodiments, it can be advantageous to have the passageway seal 60 separated into different portions. In the embodiment shown, a first portion 68 of the passageway seal 60 can be disposed in proximity to the radial protrusion 62 and a second portion 60*b* of the seal can be disposed in proximity to the radial protrusion 70. Alternatively, the seal can be made in one piece. As a practical matter, one-piece seals can advantageously be used when the radial protrusions are spaced in proximity to each other. The separate portions can advantageously be used when the space between the radial protrusion 62, 70 is increased. Further, separate portions can allow use of different materials, depending upon the design criteria.

A ball 64 is generally placed in the passageway 50, generally traveling in the passageway 50 until it engages the radial protrusion 70. Advantageously, the portion 60*b* of the seal can be sealingly engaged by the ball 64. Fluid restricted by the ball 64 can be pressurized to cause a force sufficiently large on the inner sleeve 48 to shear the pin 72. When the pin 72 shears, the inner sleeve 48 can move longitudinally, as described in FIG. 3B.

FIG. 3B is a schematic cross-sectional view of the embodiment shown in FIG. 3A with at least one other radial protrusion in a second position. The shifting or other movement of the sleeve 48 relative to the first portion 42 allows the radial protrusion 70 to engage the second actuator 74. Upon actuation, the radial protrusion can retract into the recessed portion of the second actuator 74. The passageway is cleared sufficiently to allow the ball 64 to travel further to engage the seat 58. The seat 58 forms a stop for the ball 64. However, fluid can flow around the ball 64 in that position.

Figure 3C:
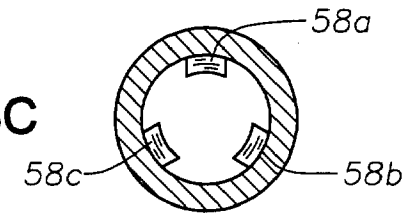
FIG. 3C is a schematic cross-sectional view across the passageway.

FIG. 3C is a schematic cross-sectional view across the passageway 50. The seat 58 can include one or more elements 58*a*, 58*b*, and 58*c*. While three elements are shown, it is to be understood that one or more elements can be used. As is described herein, a space between the seat elements allows flow past the seat elements even when a moveable restriction, such as the ball 64, is engaged with the seat 58.

Figure 3D:
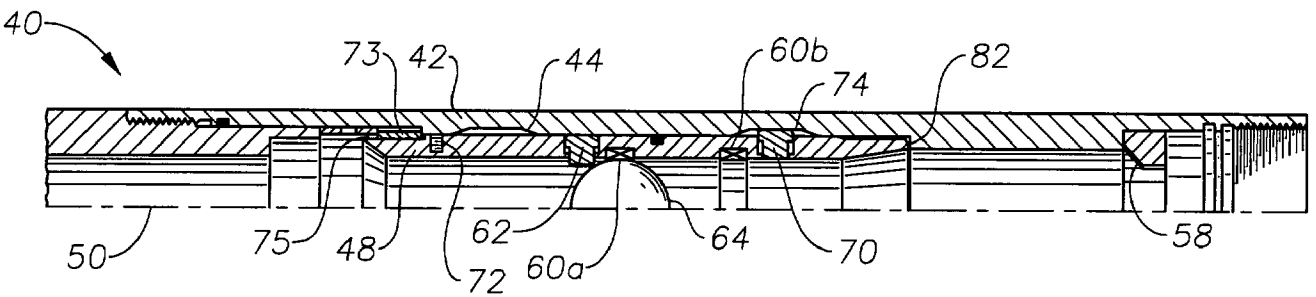
FIG. 3D is a schematic cross-sectional view of the embodiment shown in FIG. 3B in a reverse flow direction.

FIG. 3D is a schematic cross-sectional view of the embodiment shown in FIG. 3B in a reverse flow direction. The radial protrusion 70 can still be recessed into the actuator 74. However, the radial protrusion 62 has been actuated and extended into the passageway 50. Thus, if fluid downstream of the seat 58 causes the ball to move upstream, the ball is stopped by the radial protrusion 62. A seal portion 60*a*, appropriately dimensioned and located, can be used to effectively seal against the ball 64 when the ball is stopped by the radial protrusion 62. Thus, flow can be restricted in a reverse flow direction.

Figure 4A:
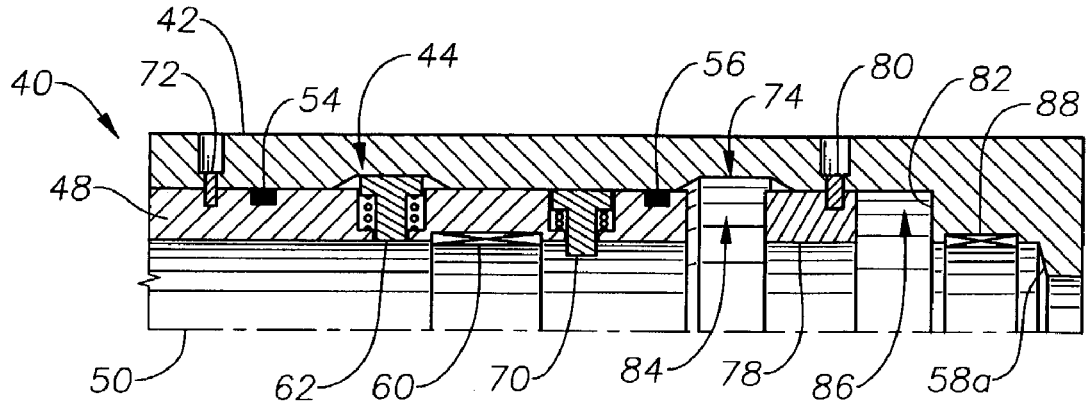
FIG. 4A is a schematic cross-sectional view of another embodiment of the present invention having at least one radial protrusion in a position.
Figure 4B:
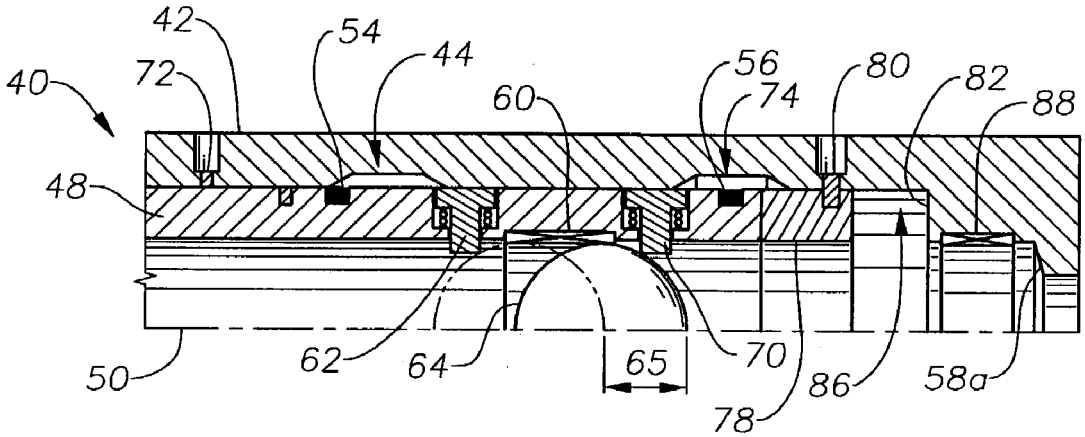
FIG. 4B is a schematic cross-sectional view of the embodiment shown in FIG. 4A where a radial protrusion is extended into the passageway to block the reverse travel of the movable restriction.
Figure 4C:
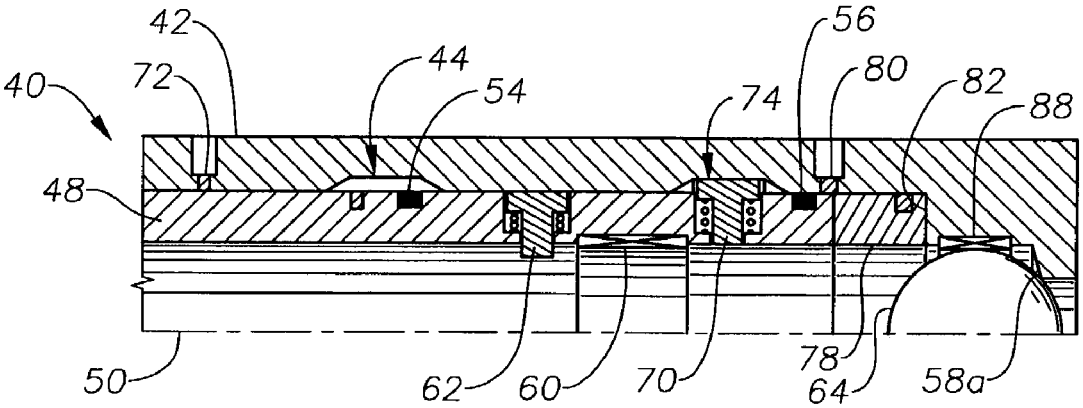
FIG. 4C is a schematic cross-sectional view of the embodiment shown in FIG. 4B with a second radial protrusion retracted from the passageway.

FIGS. 4A–4C illustrate another embodiment of the present invention having a multi-stage actuation. FIG. 4A is a schematic cross-sectional view of the embodiment having at least one radial protrusion in a position. FIG. 4B is a schematic cross-sectional view of the embodiment shown in FIG. 4A where a radial protrusion is extended into the passageway to block the reverse travel of the movable restriction. FIG. 4C is a schematic cross-sectional view of the embodiment shown in FIG. 4B with a second radial protrusion retracted from the passageway.

Referring to FIG. 4A, the first portion 42 can include a plurality of actuators, such as actuators 44 and 74. Further, the inner sleeve 48 can have a plurality of radial protrusions 62, 70. In a first relative position between the first portion 42 and inner sleeve 48, the radial protrusion 62 can be in a retracted position in conjunction with a recess portion of the actuator 44. Similarly, the second radial protrusion 70 can be in an extended position relative to the passageway 50. A passageway seal 60 can be disposed therebetween. Optionally, the relative movement between the first portion 42 and inner sleeve 48 can be restricted by a pin 72.

Further, the embodiment can also use a second sleeve 78 secured to the first portion 42 or alternatively another portion of the control system 40 with a restraining element, such as a pin 80. In at least one embodiment, the pin 80 can have a greater shear strength than the pin 72, described above. A space 84 can be formed between opposing surfaces of the inner sleeve 48 and the second sleeve 78 to allow relative movement of the first sleeve 48 with respect to the first portion 42 and the second sleeve 78. Further, a stop 82 can be formed on the first portion 42. Similarly, a space 86 can be formed between opposing surfaces of the second sleeve 78 and the stop 82 to allow for relative movement between the first portion 42 and the second sleeve 78. In at least one embodiment, a seat 58*a* can be coupled to the first portion 42 apart from the first and second radial protrusions.

When the pin 72 is sheared, the inner sleeve 48 can move relative to the first portion 42 and the second sleeve 78. The movement generally causes the radial protrusion 62 to extend inward into the passageway 50 and secure the ball 64 between the two radial protrusions. As described above, the ball 64 can sealingly engage the passageway seal 60 at one or more positions along the passageway as the ball 64 contacts the radial protrusions, depending upon the spacing of the radial protrusions, the length and thickness of the passageway seal 60, size and shape of the ball 64, and other factors known to those with ordinary skill in the art.

FIG. 4B is a schematic cross-sectional view of the embodiment showing the FIG. 4A where a radial protrusion is extended into the passageway to block the reverse travel of the movable restriction. The ball 64 has been placed in the passageway 50 or otherwise disposed in the passageway and allowed to contact the second radial protrusion 70. In at least one embodiment, the ball 64 is also in sealing engagement with the passageway seal 60 in that position. Relative movement between the inner sleeve 48 and first portion 42 occurs in conjunction with the sealing engagement between the ball 64 and the passageway seal 60. The movement shifts the sleeve 48, so that the radial protrusion 62 now is actuated and extends into the passageway 50. The ball 64 is restricted in its bi-directional movement a distance 65, which may be zero in this and in any other embodiment, similar to the bi-directional restriction described above in reference to FIGS. 2A–2D.

FIG. 4C is a schematic cross-sectional view of the embodiment shown in FIG. 4B with a second radial protrusion retracted from the passageway. The relative movement between the inner sleeve 48 and first portion 42 can continue based upon additional pressures, timing, or other factors. Although not shown, it is to be understood that the control system 40 can include additional sleeves that can be pinned or otherwise restricted relative to the movement of either of the sleeve 48 or first portion 42. Such additional sleeves can include additional radial protrusions and/or actuators. The different sleeves can be moved at the same or different pressures or other methods of activation for further control with the control system 40.

As shown, the inner sleeve 48 can contact the second sleeve 78. If the pressure is below a pressure that would create enough force to shear the pin 80, the downstream travel of the inner sleeve 48 will be arrested. Increased pressure will cause the pin 80 to shear and allow further movement of the inner sleeve 48 relative to the first portion 42. Further, the second sleeve 78 will also move until it contacts the stop 82.

The space 86, shown in FIG. 4B, can be sized to allow sufficient movement of the inner sleeve 48 and second sleeve 78 upon shearing the shear pin 80, so that the radial protrusion 70 engages the actuator 74. The radial protrusion 70 can retract into the recess portion of the second actuator 74, thus releasing the ball 64. The ball 64 moves along the passageway to engage the seat 58*a*. Optionally, another seal, such as seal 88, can be positioned adjacent to the seat 58*a* for sealing engagement therewith. It is to be understood that additional radial protrusions can be used to function as a seat 58 or 58*a*for extension and retraction into the passageway 50.

The movement of the ball 64 to the seat 58*a* can be used by the control system 40 to further cause events to occur and control the associated tool. Other events, not shown, could include further movement of the control system 40 so that the seat 58*a* retracts or is otherwise positioned so that the ball 64 is allowed to move further downstream for disposal, or other control actuation. For example, further movement of the sleeve 48 relative to the first portion 42 could in like fashion cause the radial protrusion 62 to engage the actuator 74. Upon engagement, the radial protrusion 62 could retract into the recess portion of the actuator 74. If downstream pressure were greater than upstream pressure, the retraction of the radial protrusion 62 would allow the ball 64 to be released and to flow upstream. Other movements of the radial protrusions and an appropriate pressure differential could allow the ball 64 to be released and flow downstream.

Figure 5A:
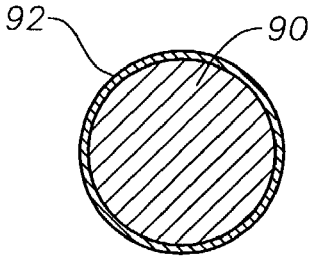
FIG. 5A is a schematic cross-sectional view of an embodiment of the movable restriction.

FIG. 5A is a schematic cross-sectional view of one embodiment of the movable restriction. As described earlier, the movable restriction is sometimes referred to herein as a "ball." However, it is to be understood that the size and shape can vary and can include circular, elongated, square, rectangular, elliptical and other shapes as may be desired for a given application. The ball 64 can be a solid ball of some appropriate material sufficient to fulfill the purposes of the present invention.

In at least one embodiment, the ball 64 can be a composite construction. For example, the ball 64 can include a core 90 made of one material and a covering 92 made of a second and different material. Further, other layers may be added in addition to the covering 92, below or above the covering.

In at least one embodiment, it may be advantageous to have a dissolvable core. For example, a dissolvable core could be advantageous for the ball 64 to eventually decrease in size and be expelled to a lower portion of the well bore, shown in FIG. 1. The core 90 could be a time-release dissolvable core of sufficient length of time, so that the ball could actuate the various controls necessary in the control system 40, as described above. In such cases, the covering 92 may be surplus. In other cases, it may be advantageous to include a relatively non-dissolvable material for the covering 92 to protect the dissolvable core 90.

Figure 5B:
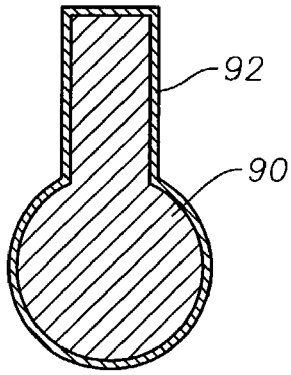
FIG. 5B is a schematic cross-sectional view of another embodiment of the movable restriction.

FIG. 5B is a schematic cross-sectional view of another embodiment of the movable restriction. The movable restriction 64 can include an extension 94. The extension 94 can be located in front of the main body of the movable restriction 64 or behind the main body, as the movable restriction moves down the passageway 50, shown for example in FIG. 3A. In like fashion, the ball 64 can have a multi-part construction, such as a core 90 and a covering 92. The extension 94 can include the same construction or different construction depending upon the time of use and structural requirements, and other aspects as would be apparent to one with ordinary skill in the art given the description provided herein.

Figure 6:
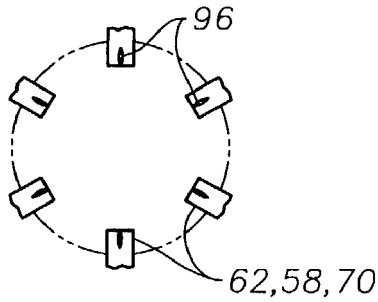
FIG. 6 is a schematic cross-sectional view of the control system having a cutter disposed in the passageway for impairment of the movable restriction.

FIG. 6 is schematic cross-sectional view across the passageway 50, such as shown in FIG. 3A, of one embodiment of a radial protrusion or seat. The seat such as seat 58, can be radially fixed in position, or retractable and extendable as has been described. Similarly, the radial protrusions 62, 70 can function as a seat in some of the above described embodiments. In either case, the seat or radial protrusions can be one or a plurality of elements placed around the periphery of the passageway 50 to act as a stop for the ball 64.

In some embodiments, it can be useful to puncture or otherwise impair the ball 64. The impairment may be especially advantageous if the ball is a composite construction having a relatively non-dissolvable covering with a dissolvable inner core. Thus, the radial protrusions or the seat may include a cutter 96. The term "cutter" is used broadly to include anything that can impair the integrity of a covering, such as the covering 92, shown in FIG. 5B. The ball 64 can contact the cutter 96 through impact or through pressure. The impact or pressure on the ball 62 and consequential engagement with the cutter 96 impairs the covering 92 and allows exposure of the dissolvable core 90. Given sufficient time and conditions, the dissolvable core 90 is substantially reduced in size sufficient to allow the remainder of the ball 64 to pass through the seat 58 or radial protrusions 62, 70 to a lower portion of the well bore.

Figure 7A:
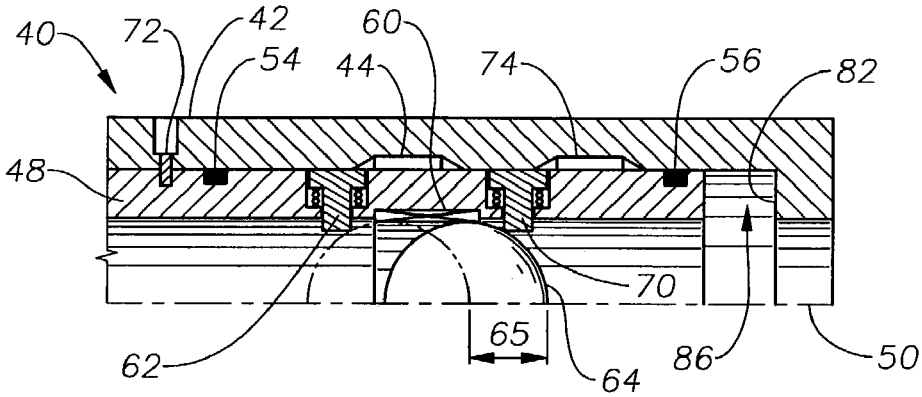
FIG. 7A is a schematic cross-sectional view of an embodiment where at least one radial protrusion is extended into the passageway to block the travel of the movable restriction.

FIG. 7A is a schematic cross-sectional view of an embodiment where at least one radial protrusion is extended into the passageway to block the travel of the movable restriction. As described in several other embodiments, the first portion 42 and the inner sleeve 48 are disposed relative to each other in an initial position. An optional shear pin 72 restricts relative initial movement therebetween. One or more actuators 44, 74 can be coupled to the first portion. The one or more actuators can actuate one or more radial protrusions 62, 70 coupled to the inner sleeve 48. A passageway seal 60 is generally disposed between the radial protrusions. A space 86 between the inner sleeve 48 allows for movement of the inner sleeve 48 relative to the first portion 42 until stop 82 is engaged.

An initial position for this embodiment can be seen as the movable restriction 64 is disposed between already extended radial protrusions 62, 70. The travel 65, which may be zero, as described above, depends on the size, distance between protrusions, size and shape of the movable restriction, and other factors known to those with ordinary skill in the art. The movable restriction 64 can be placed in this position in the control system 40 from the surface and inserted downstream in the tubular string 20, described in reference to FIG. 1. Alternatively, the movable restriction 64 could be restricted between the radial protrusions as a result of an earlier movement of another portion of the control system or even from another control system, downstream or upstream, as additional modules.

Figure 7B:
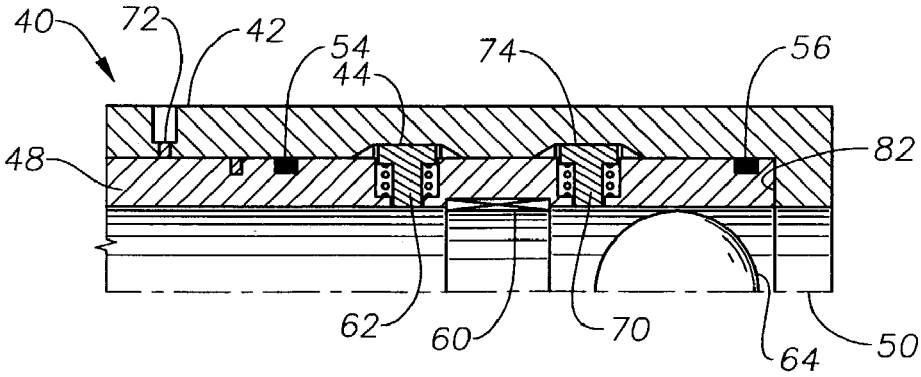
FIG. 7B is a schematic cross-sectional view of the embodiment shown in FIG. 7A with at least one radial protrusion is retracted from the passageway.

FIG. 7B is a schematic cross-sectional view of the embodiment shown in FIG. 7A with at least one radial protrusion is retracted from the passageway. Similar to other embodiments described above, relative movement between the first portion 42 and the inner sleeve 48 can cause one or more of the actuators 44, 74 to actuate one or more of the radial protrusions 62, 70. In at least one embodiment, each actuator can actuate each radial protrusion, so that each radial protrusion is retracted radially outward and away from the passageway 50. The retraction of the radial protrusions releases the movable restriction 64 to flow upstream or downstream, depending on the pressure differential. While the retraction of only one radial protrusion allows the release, it can be advantageous to retract multiple radial protrusions to allow a larger access for tools through the passageway.

Having described some of the basic concepts through various embodiments above, the below embodiments are illustrative of some of the flexibility of the control system with other features. The embodiments are non-limiting and others are possible. For example, FIGS. 8A–8C incorporate features of FIGS. 4A–4C and 7A–7B, but could incorporate other features, some of which are specifically described and others not specifically described.

Figure 8A:
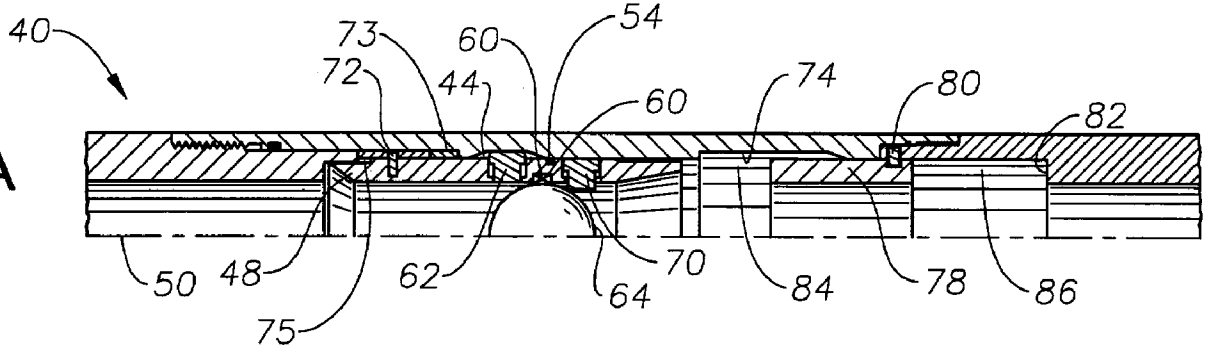
FIG. 8A is a schematic cross-sectional view of another multi-staged embodiment.

FIG. 8A is a schematic cross-sectional view of another multi-staged embodiment. The first portion 42 can include a plurality of actuators, such as actuators 44 and 74. The inner sleeve 48 can have a plurality of radial protrusions 62, 70. In a first relative position between the first portion 42 and inner sleeve 48, the radial protrusion 62 can be in a retracted position in conjunction with a recess portion of the actuator 44. Similarly, the second radial protrusion 70 can be in an extended position relative to the passageway 50. A passageway seal 60 can be disposed therebetween and exposed to the passageway 50. Optionally, the relative movement between the first portion 42 and inner sleeve 48 can be restricted by a pin 72.

An optional lock 73 can operatively interact with the first portion 42 and inner sleeve 48. The lock 73 can restrict the amount of reverse movement, once the inner sleeve has moved relative to the first portion 42. Movement of the inner sleeve relative to the first portion 42 can expose the lock 73 to a recess 75 formed in the inner sleeve. The biased lock engages the recess and restricts reverse movement of the inner sleeve relative to the first portion.

Further, the embodiment can also use a second sleeve 78 secured to the first portion 42 or alternatively another portion of the control system 40 with a restraining element, such as a pin 80. In at least one embodiment, the pin 80 can have a greater shear strength than the pin 72, described above. A space 84 can be formed between opposing surfaces of the inner sleeve 48 and the second sleeve 78 to allow relative movement of the first sleeve 48 with respect to the first portion 42 and the second sleeve 78. Further, a stop 82 can be formed on the first portion 42. Similarly, a space 86 can be formed between opposing surfaces of the second sleeve 78 and the stop 82 to allow for relative movement between the first portion 42 and the second sleeve 78.

Figure 8B:
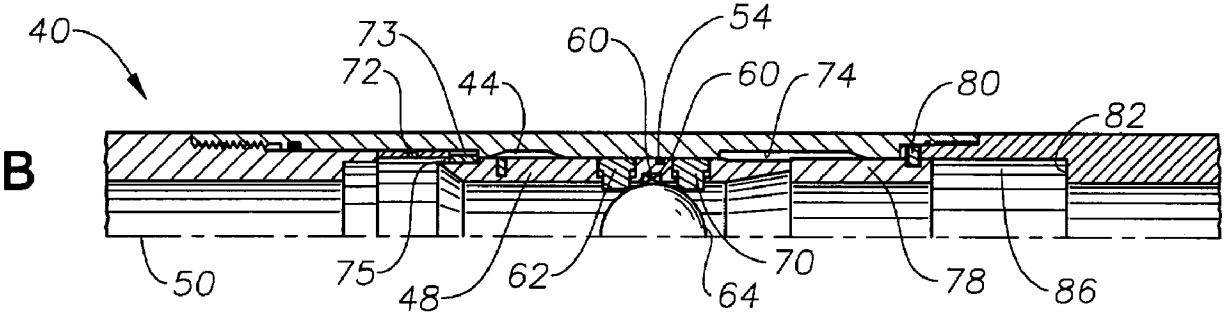
FIG. 8B is a schematic cross-sectional view of the embodiment shown in FIG. 8A in a second position.

FIG. 8B is a schematic cross-sectional view of the embodiment shown in FIG. 8A in a second position. As described above, the ball 64 can sealingly engage the passageway seal 60 at one or more positions along the passageway as the ball 64 contacts the radial protrusions, for example, the radial protrusion 70. Sufficient fluid pressure applied to the ball 64 can cause a force on the inner sleeve 42 to shear the pin 72. When the pin 72 is sheared, the inner sleeve 48 moves relative to the first portion 42 and the second sleeve 78. The movement generally causes the radial protrusion 62 to extend inward into the passageway 50 as the radial protrusion is actuated by the actuator 44. The extension of the radial protrusion secures the ball 64 between the two radial protrusions.

Further, the relative movement between the inner sleeve 48 and the first portion 42 causes the space 84 to close as the inner sleeve 48 contacts the second sleeve 78. If the pressure is below a pressure that would create enough force to shear the pin 80, the downstream travel of the inner sleeve 48 is arrested.

Figure 8C:
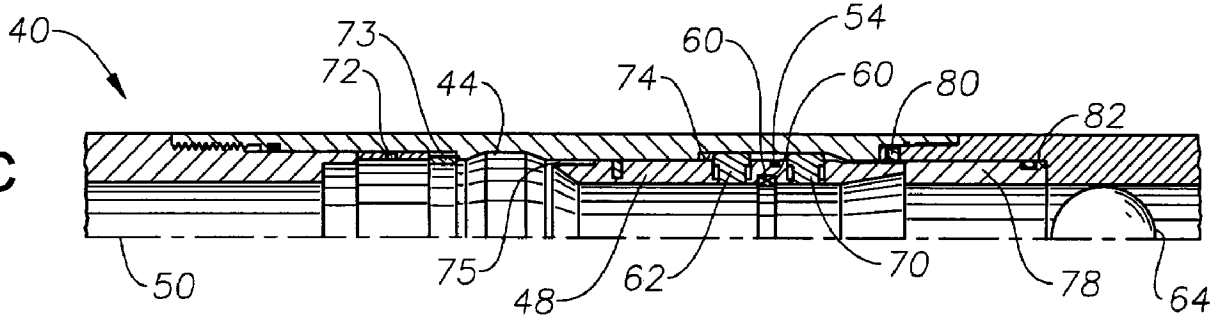
FIG. 8C is a schematic cross-sectional view of the embodiment shown in FIG. 8B in a third position.

FIG. 8C is a schematic cross-sectional view of the embodiment shown in FIG. 8B in a third position. The relative movement between the inner sleeve 48 and first portion 42 can continue based upon additional pressures, timing, or other factors. Although not shown, it is to be understood that the control system 40 can include additional sleeves or portions of sleeves that can be pinned or otherwise restricted relative to the movement of either of the sleeve 48 or first portion 42. Such additional sleeves or portions thereof can include, for example, additional radial protrusions and/or actuators. The different sleeves or portions can be moved at the same or different pressures or other methods of activation for further control with the control system 40.

Increased pressure will cause the pin 80 to shear and allow further movement of the inner sleeve 48 relative to the first portion 42. Further, the second sleeve 78 will also move until it contacts the stop 82.

The space 86, shown in FIG. 4B, can be sized to allow sufficient movement of the inner sleeve 48 and second sleeve 78 upon shearing the shear pin 80, so that the radial protrusions 62, 70 engage the actuator 74. The radial protrusions 62, 70 can retract into the recess portion of the second actuator 74, thus releasing the ball 64. The ball 64 can move upstream if the downstream pressure is greater or downstream if the upstream pressure is greater. Further, the retraction of the actuators provides a greater passageway area for subsequent tools inserted therein.

The reverse movement of the inner sleeve 48 can be arrested by designing the actuator 74 to not allow the radial protrusion 62 to radially extend back into the passageway 50 and therefore form a stop to reverse movement.

Figure 9A:
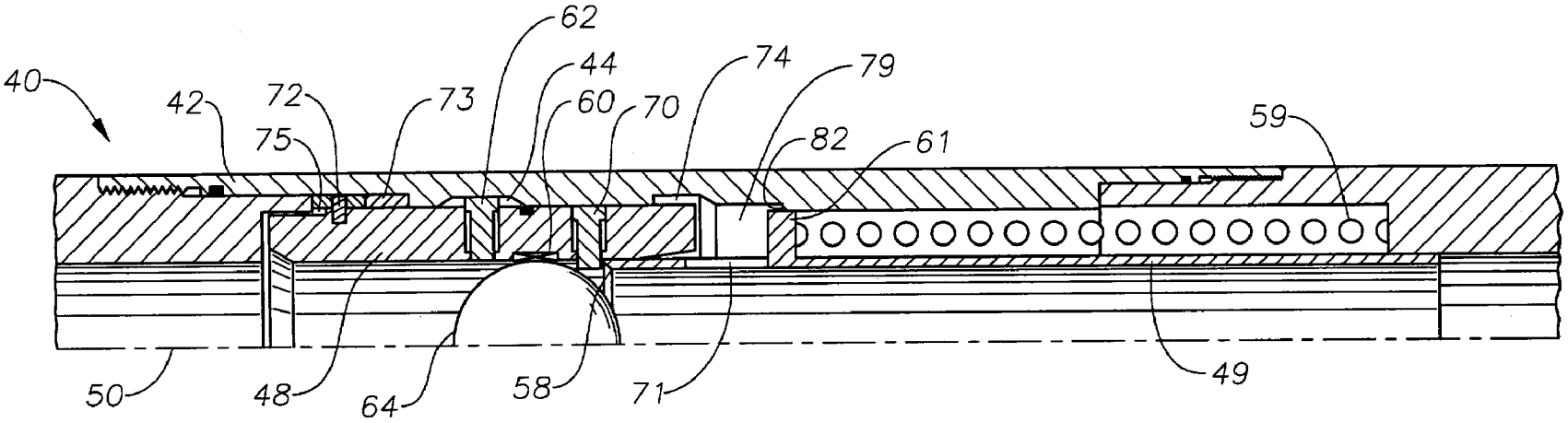
FIG. 9A is a schematic cross-sectional view of another embodiment.

FIG. 9A is a schematic cross-sectional view of another embodiment. This embodiment features, among other items, a longitudinally biased seat. Similar to the prior embodiments described, the control system 40 generally includes the first portion 42 with at least one actuator 44 and an inner sleeve 48 with at least one radial protrusion, and as shown with at least two radial protrusions 62, 70. A second actuator 74 can also be advantageously used. A passageway seal 60 can also be coupled to the control system such as to the inner sleeve. A lock 73 can operatively interact with the first portion 42 and inner sleeve 48. The lock 73 can restrict the amount of reverse movement, once the inner sleeve has moved relative to the first portion 42, by engaging a recess 75 that can be formed in the inner sleeve.

The inner sleeve 48 can include an additional inner sleeve portion 49. In at least one embodiment, the inner sleeve portion 49 is coupled to a seat 58 and is slidably engaged with the inner sleeve 48 and slidably engaged with the first portion 42. A bias element 59, such as a spring or other bias member, can bias the inner sleeve portion 49 in a longitudinal direction. Advantageously, the bias element 59 biases the seat 58 toward the radial protrusions, such as radial protrusion 70. The bias element can compress against the first portion 42 on one end and a stop 61 on the other end, such as a flange formed on the inner sleeve portion 49. A port 71 can be provided in the control system, such as in the inner sleeve portion 49, to allow fluid flow in and out of a space 79 formed between the inner sleeve 48 and the inner sleeve portion 49 during relative movements therebetween.

In one position, the radial protrusion 70 can extend radially into the passageway and form a stop for the movable restriction 64 in the passageway 50. Concurrently, the extended radial protrusion can form a stop for longitudinal movement of the biased seat 58. The movable restriction 64 can sealably engaged the passageway seal 64 and form a flow restriction. In this position, fluid pressure on the side of the movable restriction toward the radial protrusion 62 can be used to cause a force on the radial protrusion 70, thereby causing a force on the inner sleeve 48 and shear pin 72. Sufficient force can shear the pin 72 and allow the inner sleeve 48 and inner sleeve portion 49 to move longitudinally toward the bias element 59. Naturally, other restraining devices besides the pin 72 can be used and therefore is only exemplary.

Figure 9B:
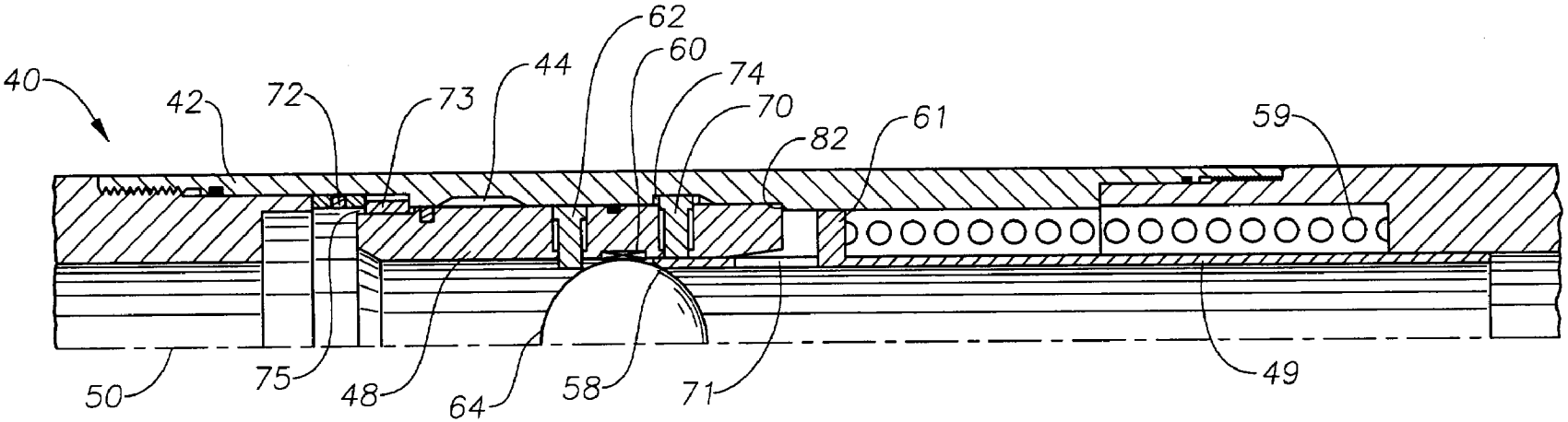
FIG. 9B is a schematic cross-sectional view of the embodiment shown in FIG. 9A in a second position.

FIG. 9B is a schematic cross-sectional view of the embodiment shown in FIG. 9A in a second position. In the second position, sufficient force exerted by the pressure on the movable restriction 64 has caused a longitudinal movement of the inner sleeve 48 and inner sleeve portion 49. The bias element 59 is compressed compared to its state shown in FIG. 9A.

Sufficient longitudinal movement allows the radial protrusion 70 to engage the actuator 74 and be retracted radially from the passageway 50. The biased seat 58 is then released from its engagement with the radial protrusion 70 and can longitudinally extend toward the radial protrusion 62 and toward the movable restriction 64 if present. Further, the radial protrusion 62 is extended radially into the passageway 50 in conjunction with the actuator 44. The radial protrusion 62 thus forms a stop for the movable restriction 64 distal from the seat 58 and the movable restriction is restricted therebetween.

The passageway seal 60 with appropriate sizing and placement can be used to sealingly engage the movable restriction 64 when concurrently engaged with the seat, radial protrusion, or a combination thereof. Flow in the passageway can thus be restricted in at least one direction and in some embodiments, such as the one shown, in both directions.

Further, the biased seat 58 can assist in maintaining engagement of the movable restriction 64 against the radial protrusion 62 and, if present, the passageway seal 60. This maintained engagement can advantageously provide a quicker response to arresting flow in the passageway.

Figure 10A:
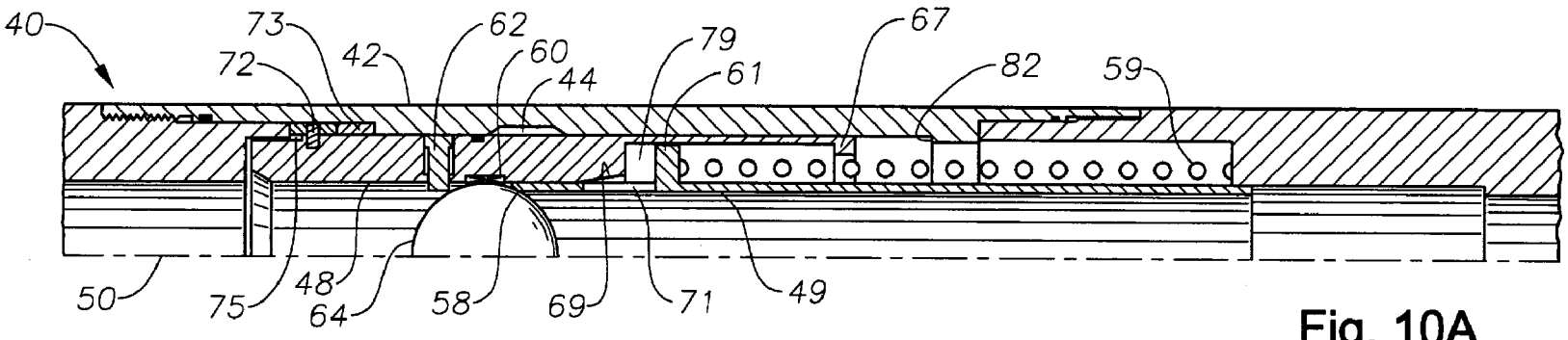
FIG. 10A is a schematic cross-sectional view of another embodiment.

FIG. 10A is a schematic cross-sectional view of another embodiment. The embodiment includes the flow restriction function, as described in other embodiments, but with the added feature of being flow rate sensitive.

In the exemplary embodiment, the control system 40 includes a first portion 42 having at least one actuator 44 coupled to an inner sleeve 48 having at least one radial protrusion 62 coupled thereto. The inner sleeve 48 can be slidably restrained with the first portion 42 by a pin 72 or other restraining device, as described above. A lock 73 coupled to the first portion can be biased to engage a recess 75 in the inner sleeve to restrict reverse movement when the inner sleeve has moved relative to first portion. A passageway seal 60 can advantageously be used to sealingly engage a movable restriction 64 disposed in the passageway 50.

Similar to the embodiment described in FIGS. 9A–9B, an inner sleeve portion 49 can be longitudinally biased with a bias element 59, so that the seat 58 is biased toward the radial protrusion 62 with the movable restriction 64 disposed therebetween. The bias element 59 can compress against the first portion 42 on one end and a stop 61 on the other end, such as a flange formed on the inner sleeve portion 49.

In the embodiment shown, the movable restriction 64 has been disposed already between the seat 58 and the radial protrusion 62. It is to be understood that such placement can be made upon installation, such as at the surface of the well, or by previous actions, such as can be caused by other control systems in the well. Further, only one radial protrusion and one actuator is shown as exemplary. However, it is also to be understood that a plurality of radial protrusions and/or actuators, such as shown in FIGS. 9A–9B, could be used in conjunction with this embodiment and other embodiments, such as those disclosed herein.

A taper 69 can be optionally formed on the inner sleeve 48 for fluid flow efficiency, as explained below. A port 71 is provided in the control system, such as in the inner sleeve portion 49, to allow fluid flow in and out of a space 79 formed between the inner sleeve 48 and the inner sleeve portion 49.

The inner sleeve 48 includes a stop 67, the inner sleeve portion 49 includes a stop 61, and the first portion 42 includes a stop 82. The stops are used to control the movements and engagements of the control system 40 in conjunction with the bias element 59.

When fluid pressure is greater on the movable restriction in the passageway 50 on the side of the bias element 59 relative to the side of the radial protrusion 62, the fluid pressure forces the movable restriction against the radial protrusion and the seal 60 to create a flow restriction in the passageway. For example, this state can occur when downstream pressure is greater than upstream pressure.

If the seat 58 is formed to seal against the movable restriction independent of the seal 60, then the flow from the direction of the radial protrusion is also restricted. Flow from the direction of the radial protrusion can still be restricted even if the seat is formed to allow flow thereby as long as the movable restriction is engaged with the seal 60. However, sufficient pressure on the movable restriction that forces the seat 59 away from the radial protrusion can allow the movable restriction 64 to disengage from the seal 60 and flow to occur.

Figure 10B:
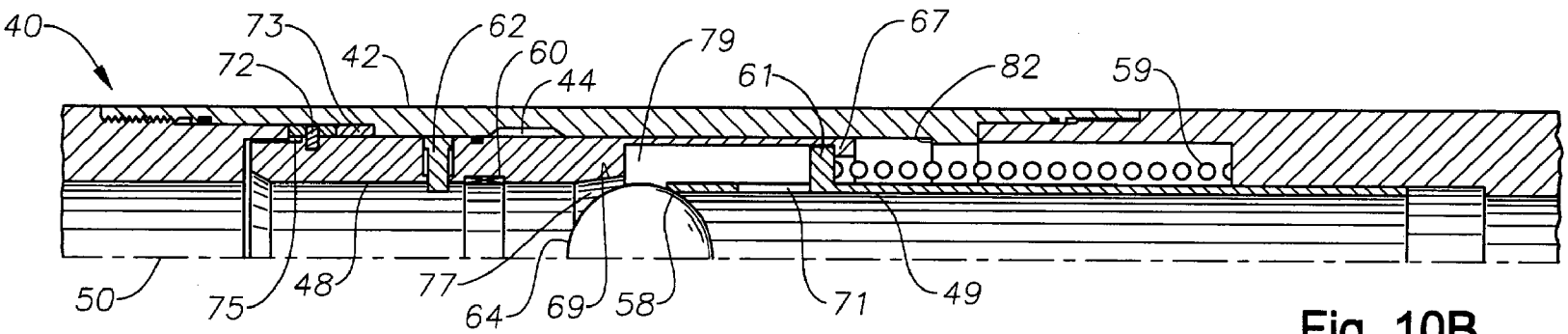
FIG. 10B is a schematic cross-sectional view of the embodiment shown in FIG. 10A in a second position.

FIG. 10B is a schematic cross-sectional view of the embodiment shown in FIG. 10A in a second position. Similar elements are similarly numbered. The inner sleeve portion 49 has moved relative to the inner sleeve 48. Generally, the movement is caused by pressure creating a force on the movable restriction 64 from the side of the radial protrusion 62 against the seat 58. The movement however is opposed by the bias element 59. The bias and resulting opposing force can be selected depending on the requirements and desires of a particular installation.

Relatively low fluid flow can move the seat 58 longitudinally so that a flow path 77 is created between the inner sleeve 48 and the movable restriction 64. Fluid can flow past the taper 69 into the space 79. The fluid flow can be directed back into the passageway 50, such as through the port 71. Greater fluid flow creates a greater pressure with greater force and additional movement of the seat until the stop 61 of the inner sleeve portion 49 engages the stop 67 of the inner sleeve 48. Thus, the embodiment is a flow rate sensitive embodiment that moves relative to the amount of flow through the control system 40.

Still greater fluid flow creates a greater pressure on the inner sleeve 48 and the inner sleeve portion 49. A force is created on the pin 72, because movement of the inner sleeve portion 49 relative to the inner sleeve 48 is arrested by the engagement between the stops 61, 67. Still greater force breaks pin 72.

Figure 10C:
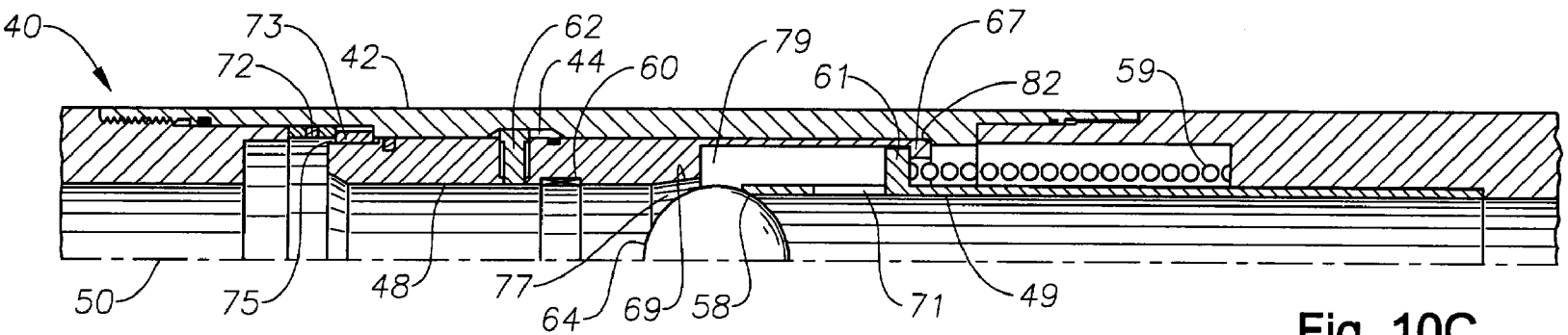
FIG. 10C is a schematic cross-sectional view of the embodiment shown in FIG. 10B in a third position.

FIG. 10C is a schematic cross-sectional view of the embodiment shown in FIG. 10B in a third position. Similar elements are similarly numbered. The inner sleeve 48 and the inner sleeve portion 49 have moved relative to the first portion 42.

Greater flow from the direction of the radial protrusion in the direction of the seat creates a sufficient force to break pin 72 and allow the inner sleeve and inner sleeve portion can move relative to the first portion. Such movement can continue until the stop 67 on the inner sleeve engages the stop 82 on the first portion. Further, the lock 73 can engage the recess 75 on the inner sleeve 48 to restrict reverse movement.

Suitable placement of the actuator 44 causes the radial protrusion 62 to retract from the passageway 50. Pressure on the side of the radial protrusion can be decreased, so that pressure on the side of the seat is greater to cause the movable restriction to flow to another portion of the well, if desired. In some instances, the flow would be upstream and the ball could be retrieved at the surface of the well. The flow characteristics of the control system can be altered by using a variety of pins 72, bias elements 59, ports 71, and other criteria known to those with ordinary skill in the art.

Figure 11A:
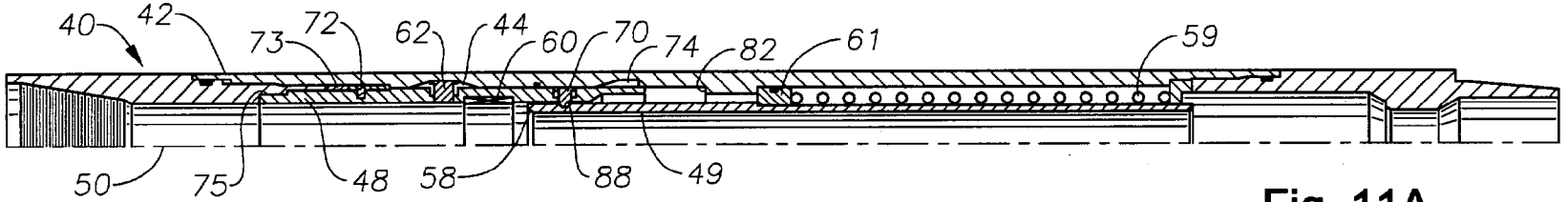
FIG. 11A is a schematic cross-sectional view of another embodiment.

FIG. 11A is a schematic cross-sectional view of another embodiment. Without limitation, the control system 40 can be inserted in the position shown in FIG. 11A into the well, shown in FIG. 1. In the exemplary embodiment, the control system 40 includes a first portion 42 having actuators 44, 74. The first portion 42 is coupled to an inner sleeve 48. Radial protrusions 62, 70 are coupled to the inner sleeve 48. The actuators 44, 74 can matingly engage the radial protrusions 62, 70 at various portions of the control system movement. The inner sleeve 48 can be slidably restrained with the first portion 42 by a pin 72 or other restraining device, as described above. A lock 73 coupled to the first portion can be biased to engage a recess 75 in the inner sleeve to restrict reverse movement when the inner sleeve has moved relative to the first portion. A passageway seal 60 exposed to the passageway 50 can advantageously be used to sealingly engage a movable restriction 64 disposed in the passageway 50. One or more stops, such as stop 82, can be formed or otherwise coupled to the first portion 42 or other elements of the control system to arrest movement of the inner sleeve 48 or portions thereof. For example, the inner sleeve movement to the left in FIG. 11A can also be restrained by a stop (not labeled), such as on the first portion 42.

Similar to some of the embodiments described herein, an inner sleeve portion 49 having a seat 58, can be coupled to the inner sleeve 48. The inner sleeve portion 49 is longitudinally biased with a bias element 59, so that the seat 58 is biased toward the radial protrusion 62. One end of the bias element 59 can be disposed against a stop 61, such as a flange, coupled to the inner sleeve portion 49. The stop 61 movement, and resulting inner sleeve portion 49 movement, are limited by the stop 82 on one side and the bias element 59 on another side.

A radial engagement portion 88 is coupled between the inner sleeve portion 49 and the inner sleeve 48, such as being formed in the inner sleeve portion 49. The radial engagement portion 88 is adapted to be selectively coupled with a radial protrusion, such as the radial protrusion 70. In the embodiment shown, the coupling occurs when the radial protrusion is extended radially toward the passageway 50 and engages a recess in the engagement portion. This engagement temporarily couples the movement of the inner sleeve 48 with the movement of inner sleeve portion 49.

Figure 11B:
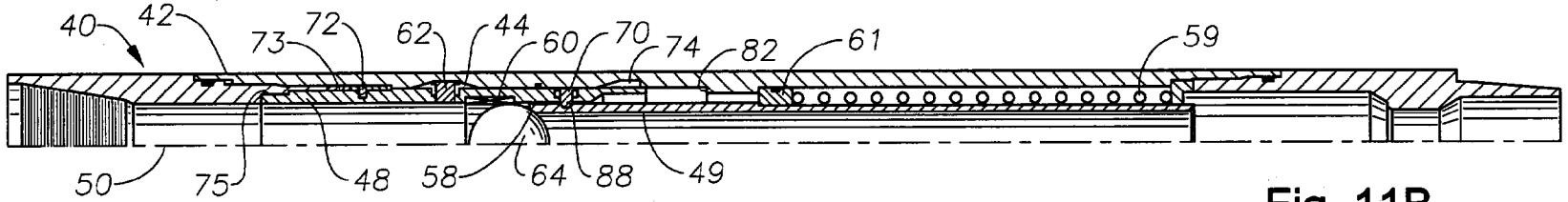
FIG. 11B is a schematic cross-sectional view of the embodiment shown in FIG. 11A with a movable restriction inserted therein.

FIG. 11B is a schematic cross-sectional view of the embodiment shown in FIG. 11A. A movable restriction 64 can be inserted into the passageway 50 from some other portion of the well, shown in FIG. 1. When fluid pressure is greater in the passageway 50 on the movable restriction 64 from the side of the radial protrusion 62, the fluid pressure forces the movable restriction against the seat 58 and the seal 60 to create a flow restriction in the passageway.

Figure 11C:
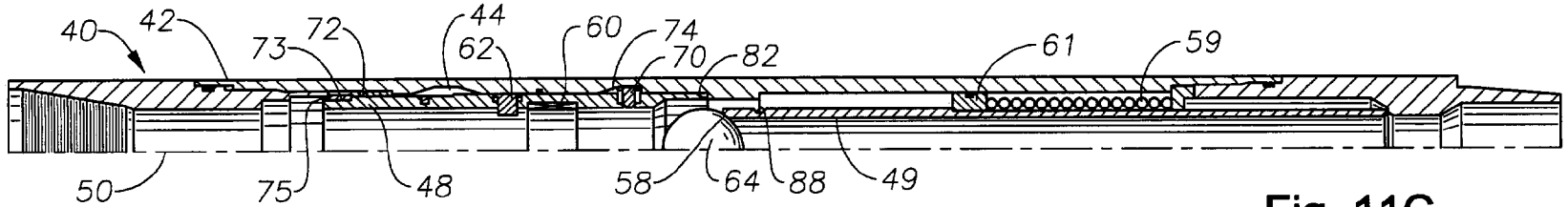
FIG. 11C is a schematic cross-sectional view of the embodiment shown in FIG. 11B in a second position.

FIG. 11C is a schematic cross-sectional view of the embodiment shown in FIG. 11B in a second position. Greater pressure forces the seat 58 with the inner sleeve portion 49 and movable restriction 64 to move in the direction of the force (for example to the right in FIG. 11C) and shears the pin 72, if present. The inner sleeve 42 moves with the inner sleeve portion 49, because the radial protrusion 70 is engaged with the radial engagement portion 88 on the inner sleeve portion 49.

Sufficient force can continue to move the inner sleeve portion 49 and inner sleeve 42 generally until the inner sleeve 42 movement is arrested, if necessary, by engagement with the stop 82. If present, the lock 73 can engage the recess 75 to restrict reverse movement of the inner sleeve 42.

Further, the movement causes the actuator 74 to engage the radial protrusion 70 and retract the radial protrusion from the passageway 50 and from the radial engagement portion 88. The retraction releases the inner sleeve portion 49 from the inner sleeve 48 and allows the movable restriction 64 to continue to move the seat 58 and inner sleeve portion 49 independent of the movable sleeve 48. If desired, ports (not labeled) can be formed in the inner sleeve portion or other portions to allow fluid to pass around the movable restriction 64 and into the well on the other side of the movable restriction. In some embodiments, the movement can be flow rate sensitive, as described above.

Figure 11D:
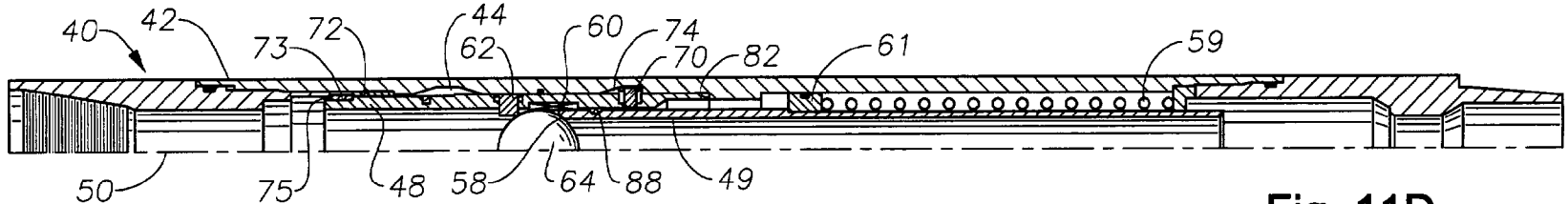
FIG. 11D is a schematic cross-sectional view of the embodiment shown in FIG. 11C in a second position.

FIG. 11D is a schematic cross-sectional view of the embodiment shown in FIG. 11C in a third position. Pressure can be decreased on the movable restriction 64 from the side of the radial protrusion 62. Alternatively, pressure can be increased, intentionally or unintentionally, on the movable restriction from the side of the inner sleeve portion 49. In either case, the greater pressure on the side of the inner sleeve portion 49 allows the bias element 59 to force the movable restriction against the radial protrusion 62 that is extended in one exemplary embodiment into the passageway 50. If the seal 60 is present, the movable restriction can sealingly engage the seal 60. The engagement assists in forming a flow restriction in at least one direction in the passageway.

Figures 12A, 12B, 12C, 12D:
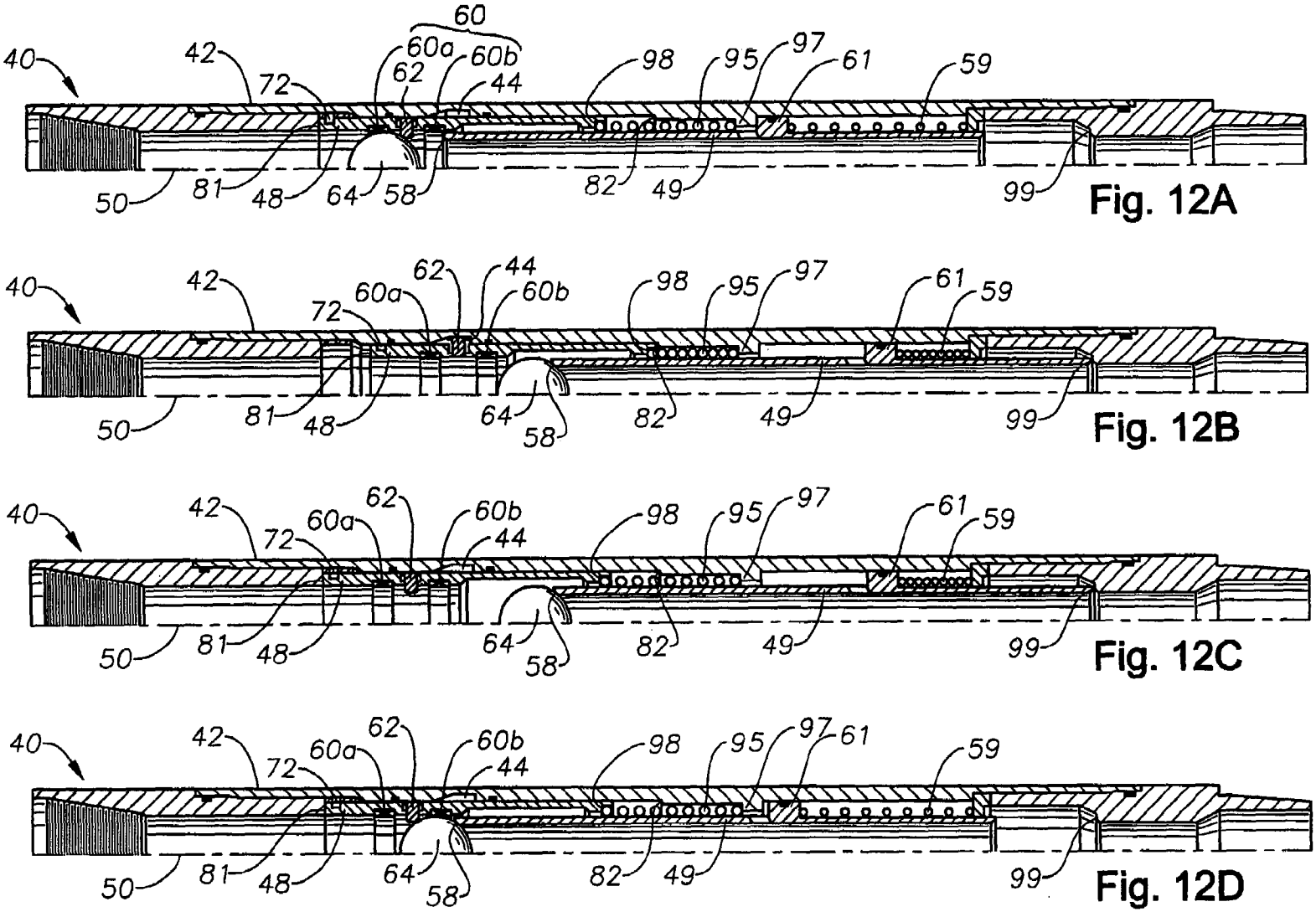
FIG. 12A is a schematic cross-sectional view of another embodiment.
FIG. 12B is a schematic cross-sectional view of the embodiment shown in FIG. 12A in a second position.
FIG. 12C is a schematic cross-sectional view of the embodiment shown in FIG. 12B in a third position.
FIG. 12D is a schematic cross-sectional view of the embodiment shown in FIG. 12C in a fourth position.

FIG. 12A is a schematic cross-sectional view of another embodiment. In the exemplary embodiment, the control system 40 includes a first portion 42 having at least one actuator 44 coupled to an inner sleeve 48. The inner sleeve has at least one radial protrusion 62 coupled thereto. The actuator 44 matingly engages the radial protrusion 62 at various portions of the control system movement. The inner sleeve 48 can be slidably restrained with the first portion 42 by an optional pin 72 or other restraining device, as described above. A passageway seal 60 exposed to the passageway from the inner sleeve or first portion is advantageously used to sealingly engage a movable restriction 64 disposed in the passageway 50. The passageway seal 60 includes at least two seal portions 60*a*, 60*b*, where one seal portion is disposed on each side of the radial protrusion 62. The seal portions allow the movable restriction to seal the passageway on either side of the radial protrusion at different stages of the control system movement.

The inner sleeve 48 movement is limited in one direction by a stop 81 and in another direction by stop 82, the stops being formed or otherwise coupled to the first portion 42 or other elements of the control system 40. Further, the inner sleeve 48 is longitudinally biased against the stop 81 by a bias element 95. One end of the bias element 95 can engage the inner sleeve at a stop 98 formed on the inner sleeve and another end of the bias element 95 can engage a stop 97 coupled to the first portion 42 or other elements of the control system 40.

Similar to some of the embodiments described above, an inner sleeve portion 49 can advantageously be used in the control system. A seat 58 is formed or otherwise coupled to the inner sleeve portion 49. A stop 61, such as a flange, is also formed or otherwise coupled to the inner sleeve portion 49 at some appropriate place along the inner sleeve portion length. The inner sleeve portion is longitudinally biased with a bias element 59, so that the seat 58 is biased toward the radial protrusion 62. The bias element 59 can compress against the first portion 42 on one end and the stop 61 on the other end. In at least one embodiment, the bias element 59 is weaker than the bias element 95.

The movement in one direction of the inner sleeve portion 49 is limited by engagement between the stop 61 and the stop 97, described above. The movement of the inner sleeve portion 49 in another direction can be limited by engagement of the inner sleeve portion with a stop 99 formed on the first portion 42 or other portions of the control system.

In operation, a moveable restriction 64 is inserted with the control system or otherwise disposed in the passageway 50 of the control system 40. The movable restriction can sealingly engage the seal portion 60*a* and create a restriction in the passageway.

FIG. 12B is a schematic cross-sectional view of the embodiment shown in FIG. 12A in a second position. Additional pressure on the movable restriction causes the movable restriction to overcome the bias of the bias element 95 and to force the inner sleeve 48 away from stop 81 and closer to stop 82. Generally, the movement of the inner sleeve is arrested when the inner sleeve contacts the stop 82 or the bias element 95 is compressed to a minimum length between the stops 97, 98.

Further, the movement of the inner sleeve 48 causes the actuator 44 to engage the radial protrusion 62 and retract the radial protrusion away from the passageway 50. The retracted radial protrusion 62 allows the movable restriction 64 to continue moving in the passageway in the direction of the force created by pressure on the movable restriction. The additional movement of the movable restriction 64 forces the inner sleeve portion 49 to continue movement and compress the bias element 59. Thus, the inner sleeve portion 49 is displaced longitudinally relative to the inner sleeve 48. The resulting relative movement between the inner sleeve 48 and the inner sleeve portion 49 allows the movable restriction 64 to be disposed on another side of the radial protrusion 62 in the passageway 50. Flow can be routed around the movable restriction, if desired, by ports (not shown) formed for example in the inner sleeve portion 49. Further, the movement can be flow sensitive, as described herein.

FIG. 12C is a schematic cross-sectional view of the embodiment shown in FIG. 12B in a third position. Continuing from FIG. 12B, the bias element 95, which was compressed due to the pressure on the movable restriction 64, is allowed to decompress and force the inner sleeve 48 backward to engage the stop 81. The reverse movement again extends the radial protrusion 62 into the passageway 50 by interaction with the actuator 44. The radial protrusion 62 then arrests the reverse movement of the movable restriction 64.

FIG. 12D is a schematic cross-sectional view of the embodiment shown in FIG. 12C in a fourth position. The movable restriction 64 has been moved backward in the passageway 50. However, at this stage, the movable restriction movement is arrested in the passageway on another side of the radial protrusion 62 from where the movable restriction originated. Further, the movable restriction can sealingly engage the seal portion 60*b* and cause a flow restriction in the passageway 50 up to desired pressure ranges from at least the direction of the seat 58. Also, the bias element 59 causes the seat 58 to exert a bias force on the movable restriction to assist the movable restriction in engaging the radial protrusion 62 and seal portion 60*b*.

While the foregoing is directed to various embodiments of the present invention, other and further embodiments may be devised without departing from the basic scope thereof. For example, the various methods and embodiments of the invention can be included in combination with each other to produce variations of the disclosed methods and embodiments, as would be understood by those with ordinary skill in the art, given the teachings described herein. Also, a plurality of the embodiments could be used in conjunction with each other in a given well for multiple control of a tool or series of tools. The control system(s) can be used as modules in conjunction with each other or other tools. Also, the directions such as "top," "bottom," "left," "right," "upper," "lower," and other directions and orientations are described herein for clarity in reference to the figures and are not to be limiting of the actual device or system or use of the device or system. The device or system may be used in a number of directions and orientations. Further, the order of steps can occur in a variety of sequences unless otherwise specifically limited. The various steps described herein can be combined with other steps, interlineated with the stated steps, and/or split into multiple steps. Additionally, the headings herein are for the convenience of the reader and are not intended to limit the scope of the invention.

Further, any references mentioned in the application for this patent as well as all references listed in the information disclosure originally filed with the application are hereby incorporated by reference in their entirety to the extent such may be deemed essential to support the enabling of the invention(s). However, to the extent statements might be considered inconsistent with the patenting of the invention (s), such statements are expressly not meant to be considered as made by the Applicant.

What is claimed is:

1. A fluid control system for a hydrocarbon well, comprising:

a first portion of the control system;

an actuator coupled to the first portion;

an inner sleeve slidably disposed inside the first portion and forming a longitudinal passageway;

a seat coupled to the control system and exposed to the passageway;

a passageway seal coupled to the inner sleeve and exposed to the passageway; and a radial protrusion disposed at least partially in the inner sleeve and distal from the seat relative to the passageway seal, the radial protrusion initially biased in a position retracted from or a position extending into the passageway and adapted to have a radial position retracted from the passageway and another radial position extended into the passageway, the radial positions determined by engagement of the protrusion with the actuator, the seat and the radial protrusion being adapted to selectively restrict in at least one direction movement of a movable restriction through the passageway, and the control system adapted to selectively restrict flow in at least one direction by sealing engagement with the movable restriction inserted in the passageway.

2. The system of claim 1, wherein the control system provides sealing engagement with the movable restriction through the seat, the radial protrusion, the passageway seal, or a combination thereof.

3. The system of claim 1, further comprising the movable restriction.

4. The system of claim 3, wherein the movable restriction comprises a covering over a disintegratable core.

5. The system of claim 4, further comprising a cutter coupled to the seat, the radial protrusion, or a combination thereof and adapted to engage the movable restriction and cause impairment of the covering to at least partially expose the core.

6. The system of claim 1, wherein the movable restriction is in contact with the passageway seal when the movable restriction is in contact with the radial protrusion to forms a flow restriction in the passageway.

7. The system of claim 1, wherein the radial positions of the radial protrusion are independent of a radial position of the seat.

8. The system of claim 1, wherein the radial protrusion is locked radially toward the passageway when actuated.

9. The system of claim 1, further comprising at least one tool associated with a hydrocarbon well that is coupled to the control system.

10. The system of claim 1, wherein the passageway seal comprises a first and second portion, wherein at least one of the portions and the radial protrusion are adapted to concurrently engage the movable restriction.

11. The system of claim 1, further comprising a second radial protrusion disposed longitudinally from the first radial protrusion in the passageway.

12. The system of claim 11, wherein both radial protrusion are adapted to retract from the passageway.

13. The system of claim 10, wherein the seat comprises the radial protrusion.

14. The system of claim 1, wherein the first portion of the control system comprises another actuator and the seat comprises another radial protrusion engageable with at least one of the actuators.

15. The system of claim 1, wherein said control system comprises a cartridge disposed within a tubular string.

16. The system of claim 1, wherein the control system comprises a modular unit coupled to other tools in a tubular string.

17. The system of claim 1, wherein the seat is longitudinally biased.

18. The system of claim 17, wherein the control system is flow rate sensitive.

19. The system of claim 1, wherein the control system comprises a multi-staged actuation.

20. A fluid control system for a hydrocarbon well, comprising:

a first portion of the control system having an actuator;

an inner sleeve slidably disposed inside the first portion and forming a longitudinal passageway;

a seat coupled to the control system and exposed to the passageway; and a radial protrusion disposed at least partially in the inner sleeve, the radial protrusion initially biased in a position retracted from or a position extending into the passageway and adapted to have a position retracted from the passageway and another position extended into the passageway, the positions determined by engagement of the protrusion with the actuator, the seat and the radial protrusion being adapted to selectively restrict in at least one direction movement in the passageway of a movable restriction disposed in the passageway between the seat and the radial protrusion.

21. The system of claim 20, further comprising a passageway seal positioned between the seat and the radial protrusion and adapted to be engaged by the movable restriction while the movable restriction is engaged with the seat, the radial protrusion, or a combination thereof.

22. The system of claim 21, wherein the control system is adapted to selectively restrict flow through the passageway in cooperation with the movable restriction inserted in the passageway between the seat and radial protrusion when the movable restriction is positioned in sealing engagement with the seat, the radial protrusion, the passageway seal, or a combination thereof.

23. The system of claim 20, further comprising the movable restriction.

24. The system of claim 23, wherein the movable restriction comprises a covering over a disintegratable core.

25. The system of claim 20, further comprising a tool associated with a hydrocarbon well that is coupled to the control system.

26. The system of claim 20, wherein the seat is longitudinally biased.

27. The system of claim 26, wherein the control system is flow rate sensitive.

28. The system of claim 20, wherein the control system comprises a multi-staged actuation.

29. A method of using a fluid control system for a hydrocarbon well, the control system comprising a first portion having an actuator, an inner sleeve slidably disposed with the first portion and forming a longitudinal passageway, a seat coupled to the control system and exposed to the passageway, and a radial protrusion initially biased in a position retracted from or a position extending into the passageway and disposed at least partially in the inner sleeve and exposed to the passageway with the seat, comprising:

allowing the radial protrusion to retract from and extend into the passageway based on actuation with the actuator;

allowing a movable restriction to engage the seat; and moving the inner sleeve relative to the first portion to cause the actuator of the first portion to extend the radial protrusion into the passageway to selectively restrict the longitudinal travel of the movable restriction between the radial protrusion and the seat.

30. The method of claim 29, wherein the control system further comprises a passageway seal disposed between the seat and the radial protrusion, and further comprising selectively restricting flow through the passageway by sealing engagement of the movable restriction with the seat, the radial protrusion, the passageway seal, or a combination thereof.

31. The method of claim 30, wherein restricting the flow is in at least one direction by sealing the movable restriction with the passageway seal when the movable restriction is engaged with the seat, by sealing the movable restriction with the passageway seal when the movable restriction is engaged with the radial protrusion, or a combination thereof.

32. The method of claim 29, further comprising pressurizing a volume of the passageway adjacent the movable restriction to cause the inner sleeve to move relative to the first portion of the control system.

33. The method of claim 29, wherein the movable restriction initially engages the radial protrusion in an extended position before the radial protrusion is retracted to allow the movable restriction to engage the seat.

34. The method of claim 29, further comprising a second radial protrusion disposed longitudinally from the first radial protrusion in the passageway and further comprising actuating the radial protrusions to control the travel of the movable restriction in the passageway.

35. The method of claim 29, wherein the seat, the radial protrusion, or a combination thereof comprises at least one cutter and the movable restriction comprises a covering disposed over a disintegratable core and further comprising impairing the covering with the cutter to expose at least a portion of the core.

36. The method of claim 29, wherein the seat is longitudinally biased and engages the movable restriction against an extended radial protrusion.

37. The method of claim 29, further comprising allowing the seat to move longitudinally in proportion to a flow rate of a fluid through the passageway.

38. The method of claim 37, further comprising increasing the flow rate so that the inner sleeve moves relative to the first portion.

39. The method of claim 38, further comprising retracting the radial protrusion and allowing the movable restriction to move longitudinally in the passageway.

40. A fluid control system for a hydrocarbon well, comprising:

a first portion of the control system having an actuator;

an inner sleeve slidably disposed inside the first portion and forming a longitudinal passageway;

a seat coupled to the control system and exposed to the passageway;

a movable restriction adapted to restrict flow in the passageway when engaged with the seat, wherein the movable restriction comprises a covering disposed over a disintegratable core.

41. The system of claim 40, further comprising a radial protrusion disposed at least partially in the inner sleeve, the radial protrusion adapted to have a position retracted from the passageway and another position extended into the passageway, the positions determined by engagement of the protrusion with the actuator, the seat and the radial protrusion being adapted to selectively restrict bi-directional movement in the passageway of a movable restriction inserted in the passageway between the seat and radial protrusion.

42. The system of claim 40, further comprising at least one cutter coupled to the seat and adapted to engage the movable restriction and cause impairment of the covering to at least partially expose the core.

43. The system of claim 40, further comprising at least one cutter coupled to the radial protrusion and adapted to engage the movable restriction and cause impairment of the covering to at least partially expose the core.

* * * * *

UNITED STATES PATENT AND TRADEMARK OFFICE

CERTIFICATE OF CORRECTION

PATENT NO. : 7,021,389 B2
APPLICATION NO. : 10/373319
DATED : April 4, 2006
INVENTOR(S) : Bishop et al.

It is certified that error appears in the above-identified patent and that said Letters Patent is hereby corrected as shown below:

In column 24, line 27, please delete “forms” and insert therefor --form--.

Signed and Sealed this

First Day of August, 2006

JON W. DUDAS
*Director of the United States Patent and Trademark Office*